US008672745B2

(12) United States Patent
Suda et al.

(10) Patent No.: US 8,672,745 B2
(45) **Date of Patent: *Mar. 18, 2014**

(54) GAMING MACHINE

(75) Inventors: Satoshi Suda, Las Vegas, NV (US); Daisuke Nakamura, Las Vegas, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/526,207

(22) Filed: Jun. 18, 2012

(65) Prior Publication Data

US 2012/0258785 A1 Oct. 11, 2012

Related U.S. Application Data

(63) Continuation-in-part of application No. 12/454,960, filed on May 27, 2009, now Pat. No. 8,231,452.

(51) Int. Cl.
*A63F 9/24* (2006.01)

(52) U.S. Cl.
USPC ..... 463/25; 463/26; 463/16

(58) Field of Classification Search
USPC ..... 463/20, 42, 26, 17, 30
See application file for complete search history.

(56) References Cited

U.S. PATENT DOCUMENTS

| | | | | |
|---|---|---|---|---|
| 6,939,228 | B2 * | 9/2005 | Shimizu | 463/20 |
| 2004/0127282 | A1 * | 7/2004 | Naobayashi | 463/20 |
| 2009/0124391 | A1 * | 5/2009 | Nelson et al. | 463/42 |
| 2010/0137061 | A1 * | 6/2010 | Ellis | 463/26 |

* cited by examiner

*Primary Examiner* — Masud Ahmed
(74) *Attorney, Agent, or Firm* — Masuvalley & Partners

(57) ABSTRACT

The present invention is a gaming machine including a display, which shows a plurality of cells indicating a plurality of symbols, and a controller, which selects a cell in a cell-selecting stage provided between a primary game and a secondary game on the display, controls the plurality of symbols in the secondary game and gives a predetermined function to the selected cell in the secondary game and where the selected cells or columns can change position on display during game play but the quantity of selected cells remain fixed for all free spin games of a secondary game.

20 Claims, 27 Drawing Sheets

GAMING MACHINE

This application is a continuation-in-part (CIP) of application Ser. No. 12/454,960 filed on May 27, 2009 which is herein incorporated by reference.

TECHNICAL FIELD

The present invention relates to gaming machines having a primary game and a secondary game for use in casinos, pachisuro slot machine parlors, etc.

BACKGROUND OF THE INVENTION

Slot machines are popular gaming machines in casinos. There are many types of slot machines and some of the slot machines have a display for displaying a plurality of cells or columns in which symbols (or indicia) are shown randomly in each game. When the symbols shown in the cells or columns form one or more winning combinations, a corresponding prize is paid to the player. Also, recent slot machines typically have a primary game and a secondary game. The secondary game may comprise any type of game, either similar to or completely different from the primary game. The secondary game is initiated upon the occurrence of a selected event or outcome of the primary game. For example, the secondary game may be embodied as a free spin game, which comprises one or a series of slot games conducted "for free", i.e., without requiring wager or credit paid by the player. Each slot game, which contains start and stop of rotation of the reels along which symbols are arranged, may be called a reel spin. Often times, the secondary game is carried out as a bonus game of the primary game, and therefore designed so that higher prizes may be paid to the player to whereby enhance the excitement of the player.

One example of the above gaming machine is disclosed in U.S. Pat. No. 6,805,632. This patent is related to a video slot machine. The video slot machine includes a display device for displaying a plurality of symbols in a grid having a plurality of cells defined by rows and columns, a memory device for storing a pay-table, and a game controller coupled to the display device and the memory device. The game controller is adapted to randomly select the symbols to be displayed in the display device and to determine an outcome based on the displayed symbols, pay-table, and predetermined pay lines in the primary game and the secondary game. The selected symbols occasionally include a bonus symbol. The game controller is adapted to identify the presence of the bonus symbol in one of the cells of a column and to modify all of the symbols within the column to wild.

However, as the players get used to the gaming machines having primary and secondary games, the excitement provided by the gaming machines tends to be insufficient to fully satisfy the players. Thus, new features are necessary to satisfy demands of the players for greater excitement and thereby entice a longer play period. Particularly, when the secondary game is of the same type of game as the primary game (for example, when the primary game is a slot game and the secondary game consists of a free spin game), the secondary game can be less entertaining to the players. Thus, a secondary game having novel features is demanded in order to provide a higher excitement to the players. However, designing a totally new game for the secondary game would require a considerable time and cost. Under such circumstances, there is a need for a novel gaming machine having a primary game and a secondary game that can provide a higher level of excitement to the player with minimum modifications to the existing gaming machines. The gaming machine of the present invention is directed to satisfying these needs.

SUMMARY OF THE INVENTION

In one embodiment of the gaming machine disclosed, a primary game and a secondary game are available to be played. The secondary game is triggered or initiated by some event of the primary game. The game is played on a gaming machine with a display. A plurality of cells is displayed on the display screen. These cells contain or are for holding symbols where a symbol is chosen from a set or plurality of symbols.

In the present disclosure, cells are represented in at least two groups. These two groups of cells are referred to as selected cells and non-selected cells. The selected cells represent a group of one or more cells that are selected for some particular function that is distinct from the non-selected cells. These selected cells are useful in the secondary game for a predetermined purpose.

Once the controller has chosen all of the selected cells for that round of game play, the number of those selected cells remains constant throughout the secondary game play instituted by the controller. The number of selected cells for the secondary game is called a quantity of selected cells.

The controller chooses the selected cells also referred to as the at least one selected cell in a cell-selecting stage. The selected cells are then distinctly indicated, marked or shown in contrast to non-selected cells. This cell-selecting stage occurs between the primary and the secondary game. It may be that a second free spin game is received by the player. The controller determines the function of the selected cells in the secondary game.

In another embodiment, symbols for the game may be a composition of two other symbols in the set of symbols available in the gaming machine.

In another embodiment the symbols in the selected cells have different shapes than those in the non-selected cells. Each of the selected cells can contain symbols with a different shape than any non-selected symbol. In another embodiment, the color of the selected cells is different than the color of the non-selected cells. For example, selected cells may be highlighted in blue whereas non-selected cells may be without special highlight. As another example, it may be that the selected cells are highlighted in green and non-selected cells are highlighted in red. In another embodiment, one or more cells are selected in the cell-selecting stage. In another embodiment, more than one cell is selected in the cell-selecting stage. In another embodiment, the selected cells show a wild symbol. In another embodiment, the primary game is a slot game where sequences of symbols are defined by reel strips.

In one embodiment, a gaming machine envisioned herein includes a display and a controller. The display shows or otherwise displays several reels in several cells. The several reels constitute a plurality of reels and the several cells constitute a plurality of cells. Each reel defines a sequence of the symbols. These symbols are selected from a set of a plurality of symbols which are available on the gaming machine. Each of those cells contains or otherwise shows a result symbol from a reel. These cells are represented as three groups: 1) a first group of selected cells (the at least one selected cell in the first group); 2) a second group of selected cells (the at least one selected cell in the second group); and 3) non-selected cells. The selected cells in the first group are distinct from the selected cells in the second group. The controller executes a free spin game whereby each reel is spun from an initial position to a result symbol. The controller chooses the selected cells in the first group and chooses the selected cells in the second group. The number of cells in the first group is indicated as a first quantity and the number of cells in the second group is indicated as a second quantity. The controller chooses each selected cell in the first group and each selected cell in the second group in a cell-selecting stage. The cell-selecting stage occurs before the free spin game is executed. Each of the selected cells is distinctly indicated on the display. The first group is distinctly indicated from the second group which is distinctly indicated from the non-selected cells on the display. The control chooses the function of the cells in the first group and the function of the cells in the second group in the free spin game. The controller also determines the outcome of the free spin game. The first quantity and the second quantity remain constant until the free spin game ends. The free spin game may encompass any number of individual free spin games initiated by the controller as part of that secondary game play.

In another embodiment, the selected cells in the first group can change position on the display. In another embodiment of the gaming machine envisioned, the symbols in both the first group and the second group remain unchanged in a subsequent reel spins associated with the free spin game following the first reel spin. In another embodiment, the selected cells in the second group, the at least one selected cell in the second group, change position on the display during the free spin game. In another embodiment, at least one symbol is a composition of at least two other symbols in the plurality of symbols. In another embodiment, the first quantity is greater than one. In another embodiment, the second quantity is greater than one. In another embodiment, each selected cell in the first group displays a wild symbol and each selected cell in a second group displays a wild symbol.

In yet another embodiment, a gaming machine is provided with a display and a controller. The display shows a plurality of reels in a plurality of cells. The reels specify a sequence of symbols in which each symbol is selected from a plurality of symbols. Each cell displays or contains a result symbol from one of the plurality of reels. The plurality of cells is composed of non-selected cells, selected cells in a first group, and selected cells in a second group. The controller executes a free spin game where each reel is spun from an initial position to a result symbol. The controller chooses the selected cells in the first group (referred to as the at least one selected cell in a first group). The number of cells chosen in the first group is referred to as a first quantity of selected cells. The controller chooses the selected cells in the second group (referred to as the at least one selected cell in a second group). The number of cells chosen in the second group is referred to as a second quantity of selected cells. The controller chooses each of the cells in the first group and the second group in a cell-selecting stage before the free spin game is executed. Each of the groups of cells, the non-selected cells, the first group of selected cells, and the second group of selected cells are distinctly indicated on the screen one from another. The controller chooses the function of the first group, and the function of the second group in the free spin game; that is, the controller chooses the function of the groups for the purpose they will perform in the free spin game. The controller determines an outcome of the free spin game. A distinguishing feature being that the first quantity and the second quantity remain constant for the duration of the free spin game.

In another embodiment, each selected cell in the first group changes position on the display during the free spin game. In another embodiment, the symbol displayed in the first group of selected cells and the symbol displayed in the second group of selected cells remains the same in a second reel spin of the free spin game. In another embodiment, the first group of selected cells has a first symbol in each of the cells of the first group. The second group of selected cells has a second symbol in each of the cells of the second group. The second symbol, which is the symbol in the second group, is different than the first symbol, which is the symbol in the first group.

In another embodiment, the selected cells in the second group change position on the display during the free spin game. In other embodiments, either first quantity or the second quantity or both is greater than one. In another embodiment, the symbols displayed in the first group of selected cells and the symbols displayed in the second group of selected cells are wild symbols.

In yet another embodiment of the current disclosure, a gaming machine that includes a primary game and a secondary game where the secondary game is initiated by an event of the primary game is provided for. The gaming machine includes a display and a controller. The display shows a plurality of columns where each column contains a plurality of cells. Each cell contains a symbol from a plurality of symbols. The plurality of columns is composed of non-selected columns and selected columns. The selected columns are referred to as the at least one selected column. The number of selected columns represents the quantity of selected columns. The quantity of selected columns remains constant until the secondary game ends. There may be multiple games played in the secondary game as determined by the gaming machine in that round of the secondary game. The controller chooses the selected columns which are referred to as the at least one selected column in a column-selecting stage between the primary game and the secondary game. The selected columns are distinctly indicated on the display from the non-selected columns. The controller chooses the function of the selected columns in the secondary game; the controller chooses the function of the selected columns for a specified purpose or function for use in the secondary game.

In another embodiment of the gaming machine where one or more columns are selected, the selected columns change position during the secondary game. In yet another embodiment of column selecting version of the gaming machine, the primary game is a slot game conducted using reels.

One aspect of the present invention may be a gaming machine that includes a display, which shows a plurality of cells indicating a plurality of symbols, and a controller, which selects a cell in a cell-selecting stage provided between a primary game and a secondary game on the display, controls the plurality of symbols in the secondary game and gives a predetermined function to the selected cell in the secondary game.

By providing a game stage having a new concept of cell-selection between the primary game and the secondary game, it is possible to attract the player's attention to the selected cell. The player may anticipate an excellent award is to be acquired because of the presence of the selected cells. A player max have a good feeling and new experience for the game play.

Cell-selection between the primary game and the secondary game can provide the player with a new expectation of game results, which do not exist in conventional gaming machines. The gaming machine having a cell-selection stage between the primary game and the secondary game can provide higher excitement to the player. Further, since the selected cell is used to perform a given predetermined function in the secondary game, the player can have new feeling, a renewed excitement, from the secondary game even if the basic configuration of the secondary game is otherwise the same as the conventional one. The characteristics of the secondary game can be changed significantly depending on which cell has been selected and/or what function has been given to the selected cell. Thus, the player can play the game for an extended period of time without becoming bored. Further, the game designer can easily adjust the characteristics of the game by changing the parameters related to cell-selection, such as frequency of occurrence of cell selection, number of cells selected, and the function provided to the selected cells without modifying the basic configuration of the secondary game. These parameters for cell-selection are not limited to only those mention but other parameters may be used.

The controller may decide whether zero or one or more cells in the cell-selecting stage are selected. In other words, it is possible to design the cell-selecting stage such that no cell may be selected by the controller in the cell-selecting stage. With this arrangement, there is a possibility that no cell is selected in the cell-selecting stage. The excitement of the player can be increased thereby when one or more cells are selected.

The controller may select more than one of the plurality of cells in the cell-selecting stage. In such a case, the controller may show the same symbols on all of the selected cells in the secondary game. Alternatively, the controller may show a plurality of symbols related to each other in the selected cells in the secondary game. In yet another alternative, the controller may show a plurality of wild symbols in the selected cells. With these arrangements, the player can have more or varied expectation of a large award in the secondary game because the probability of winning increases by the presence of the wild symbols.

In one preferred embodiment, the primary game and the secondary game may be designed to perform a slot game using reel strips provided in the gaming machine. The symbols are arranged along the reel strips so that when the reels formed by the reel strips stop rotating, certain symbols are shown in the cells. It should be noted here that the reel strips and the reels may be mechanical ones that are used in mechanical slot machines or virtual (or simulated) ones that are used in video slot machines. The reel strips may be used not only in the primary and secondary games but also in the cell-selecting stage to select a cell or indicate a selected cell. This can be done, for example, by rotating the reels for a while and showing a predetermined symbol in the selected cell when the rotation of the reels is stopped in the cell-selecting stage. In this way, the present invention can be favorably applied to the conventional slot machines having primary and secondary games, to whereby provide the players with higher excitement owing to the cell-selecting stage. Also, the reel strips used in the cell-selecting stage can be different from those used in the primary and secondary games. This can be achieved in video slot machines by using different virtual reel strips (i.e., having different symbol arrangements) for the cell-selecting stage and for the primary and secondary games. Different reel strips may be used for the primary game and for the secondary game in video slot machines. In mechanical slot machines, a structure having outer and inner reels may be used for such purpose, where the outer and inner reels may be concentric or non-concentric. Specifically, each outer reel may be given a different symbol arrangement from that of the associated inner reel and the outer reels may be used in the cell-selecting stage while inner reels may be used in the primary and secondary games, for instance.

The secondary game is typically configured as a free game, i.e., conducted without requiring a wager placed by the player. The secondary game is usually provided as a bonus game for entertaining the player, requiring a wager may decrease the player's pleasure provided by the secondary game.

The controller may select more than one of the plurality of cells in the cell-selecting stage and show a plurality of symbols related with each other under a substantially static state on the selected cells on the display while moving the symbols in non-selected cells in the secondary game. For example, the movement of the symbols in the non-selected cells may be caused by rotating mechanical or video reels on which the symbols are arranged. In mechanical slot machines, the substantially static display of the mutually-related symbols in the selected cells can be achieved by using a transparent display such as a transparent LCD (liquid crystal display) overlying the mechanical reels, for example. In this arrangement, the player can easily recognize the related symbols shown on the selected cells. Because the related symbols frequently lead to a large award, the player can have a high expectation on the large award.

Another aspect of the present invention may be a gaming machine including a display, which displays a plurality of reels presenting a plurality of indicia controlled along the reels so as to be indicated in a plurality of cells defined on the display, and a controller, which executes a free spin game, in which a plurality of reel spins are conducted during a term from an initiation to a termination of the free spin game and a game result is evaluated for each reel spin based on the indicia indicated in the cells, selects a cell before an execution of the free spin game, and gives a predetermined function to the selected cell in the free spin game.

By providing the cell-selection before the execution of the free spin game and providing a predetermined function to the selected cell in the free spin game, a greater excitement can be provided to the player though the basic configuration of the free spin game may remain the same as the conventional one. The characteristics of the free spin game can change significantly depending on which cell has been selected and/or what function has been given to the selected cell. Thus, the player can play the game for an extended period of time without becoming bored. Furthermore, the game designer can easily adjust the characteristics of the game by changing the parameters related to the cell-selection In the cell-selection, it is possible that the controller may select no cell. The possibility that no cell may be selected in the selection can increase the excitement of the player when one or more cells are selected in the selection.

The controller may show a same indicium on the selected cell for more than one reel spin in the free game. Also, when a plurality of cells are selected in the selection, it is possible to show a same indicium on the selected cells. With these arrangements, the apparent likelihood of winning increases and the player's expectation to a large award is enhanced.

The controller may select at least one cell as a first group and select at least one cell as a second group in the selection. The controller may show an indicium or symbol on the cell(s) selected as the first group and show an indicium, which is independent of the indicium shown on the cell(s) selected as the first group, on the cell(s) selected as the second group. Thus, by dividing the selected cells into two groups and assigning the indicia to the two groups independently, it is possible to achieve wider variety of characteristics to the free spin game. Thus, the player's opportunity to become bored with the game decreases.

The indicium shown on the cell(s) selected as the first group may be different from the indicium shown on the cell(s) selected as the second group. The controller may show indicia on the cell(s) selected as the first group and on the cell(s) selected as the second group at the same timing or at different timings.

Another aspect of the present invention may be a gaming machine including: a display which shows a plurality of columns for indicating a plurality of symbols therein; and a controller which controls the plurality of symbols indicated in the columns, implements a column-selecting stage between a primary game and a secondary game to select a column among the plurality of columns, and gives a predetermined function to the selected column in the secondary game.

By providing a game stage having a new concept of column-selection between the primary game and the secondary game, it is possible to attract the player to the selected column and the player may anticipate an excellent award related to the selected column. A player may experience a good feeling and renewed excitement. The provision of column-selection between the primary game and the secondary game also makes it possible to provide the player with new expectation on the game results, which did not exist in the conventional gaming machines. Thus, the gaming machine including a game stage having a new concept of column-selection between the primary game and the secondary game can provide higher excitement to the player. Further, since the selected column or columns perform the given predetermined function in the secondary game, the player may have new feelings from the secondary game even if the basic configuration of the secondary game is otherwise the same as the conventional one. The characteristics of the secondary game can be changed significantly depending on which column has been selected and what function has been given to the selected column. Thus, the player can play the game for an extended period of time without becoming bored. Further, the game designer can easily adjust the characteristics of the game by changing the parameters related to the column-selection, such as a frequency of occurrence of column selection, number of columns selected, and the function provided to the selected column without otherwise modifying the basic configuration of the secondary game. These parameters for column-selection are not limited to only those mention but other parameters may be used.

In the column selection stage, it is possible that the controller may select zero columns. By this arrangement, there is a possibility that no column may be selected in the column-selecting stage. The player's pleasure may increase thereby when one or more columns are selected in the column selecting stage. This increases the entertainment value of the gaming machine.

The controller may show a plurality of symbols related with each other on the selected column. The controller may select more than one of the plurality of columns in the column-selecting stage. In the case where more than one of the columns are selected, the controller may show the same symbols with the same order on each of the selected columns on the display in the secondary game.

In one preferred embodiment, the primary game and the secondary game may be designed to perform a slot game using reel strips provided in the gaming machine. The symbols are arranged along the reel strips so that when the reels formed by the reel strips stop rotating, certain symbols are shown in the columns. The reel strips and the reels may be mechanical ones that are used in mechanical slot machines or virtual (or simulated) ones that are used in video slot machines. The reel strips may be used not only in the primary and secondary games but also in the column-selecting stage to select a column or indicate a selected column. This can be done, for example, by rotating the reels for a while and showing a predetermined symbol in the column when the rotation of the reels is stopped in the column-selecting stage. In this way, the present invention can be favorably applied to the conventional slot machines having primary and secondary games, to whereby provide the players with higher excitement owing to the column-selecting stage. The reel strips used in the column-selecting stage can be different from those used in the primary and secondary games. This can be achieved in video slot machines by using different virtual reel strips (i.e., having different symbol arrangements) for the column-selecting stage and for the primary and secondary games. Different reel strips may be used for the primary game and for the secondary game in video slot machines. In mechanical slot machines, a structure having outer and inner reels may be used for such purpose, where the outer and inner reels may be concentric or non-concentric. Specifically, each outer reel may be given a different symbol arrangement from that of the associated inner reel and the outer reels may be used in the column-selecting stage while inner reels may be used in the primary and secondary games, for instance.

BRIEF DESCRIPTION OF THE DRAWINGS

Other and further objects, features and advantages of the invention will appear more fully from the following description with reference to the appended drawings, in which.

DETAILED DESCRIPTION OF INVENTION

In one embodiment of the gaming machine disclosed, a primary game and a secondary game are available to be played in which the secondary game is triggered or initiated or entered by some event of the primary game. The gaming machine is able to execute both the primary and secondary game. The secondary game is a chance for the player to earn a reward in the game with special features that are activated by the gaming machine initiating a secondary game. The award for the secondary game may be greater than that of the primary game. The probability of winning the secondary game may also be greater than that of the primary game. Often, the secondary game is a free game initiated on the gaming machine by some recognized event that occurs during the primary game.

Figure 1:
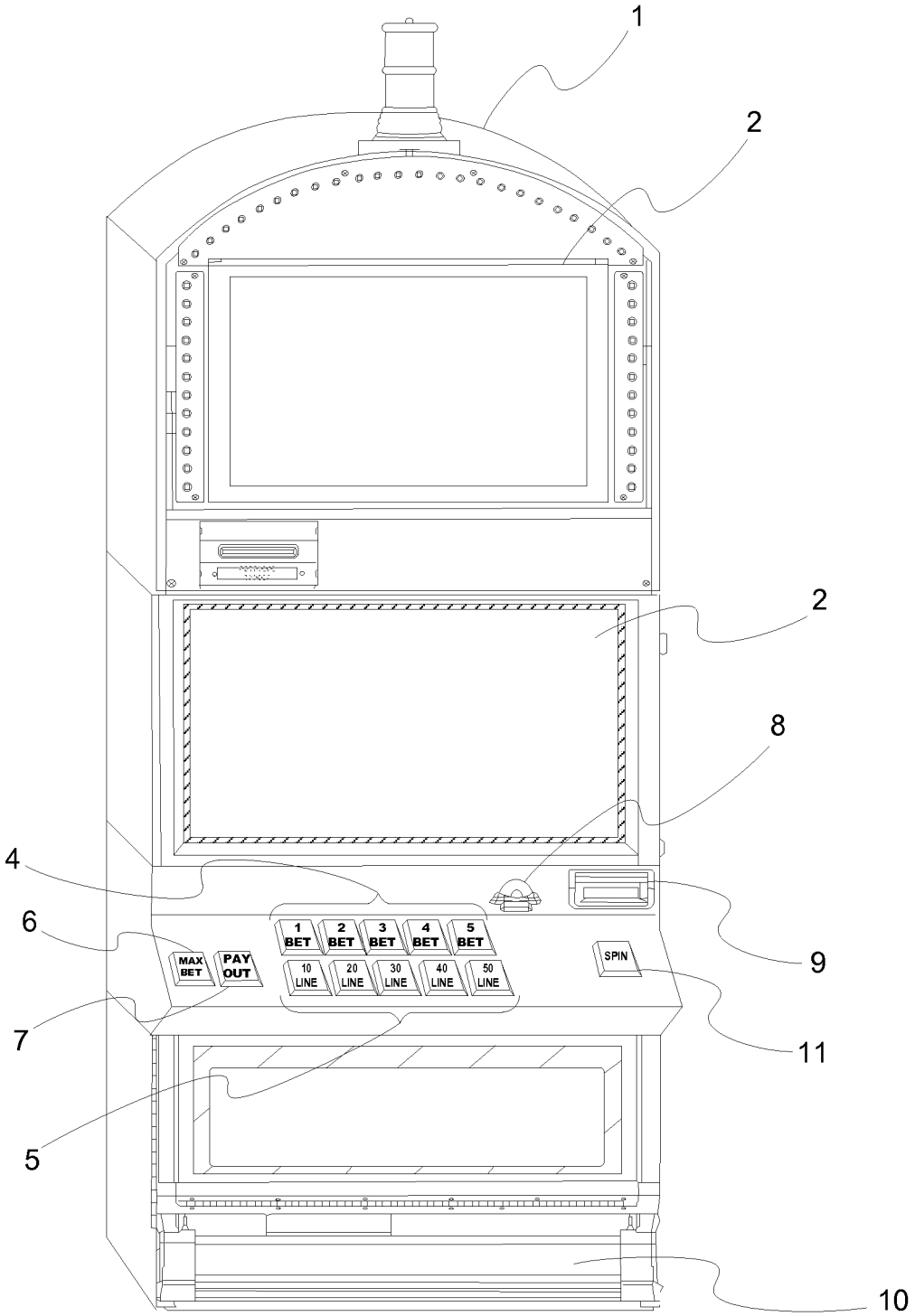
FIG. 1 is a perspective view illustrating an example of a gaming machine of the present invention.
Figure 24:
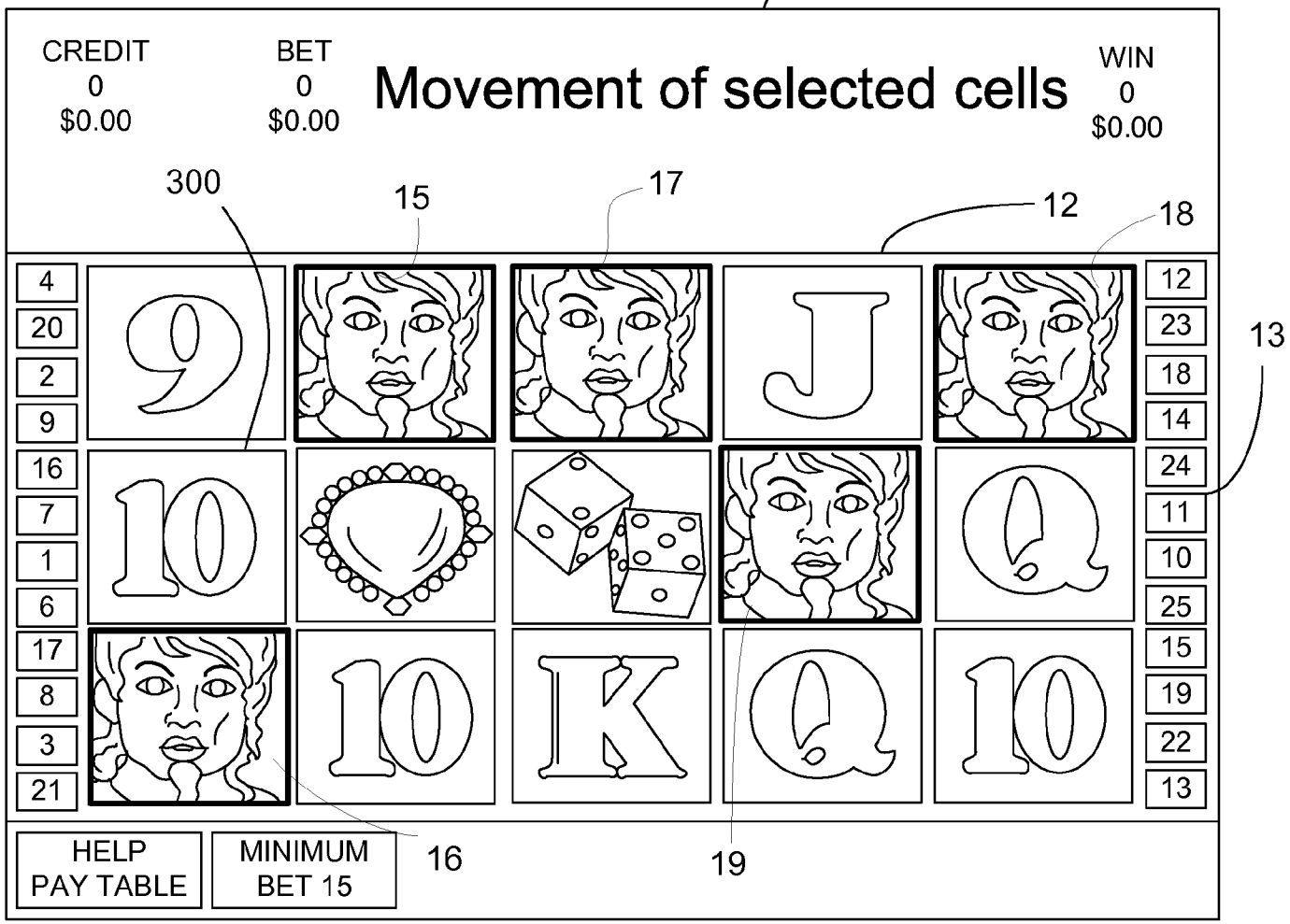
FIG. 24 is a diagram illustrating an example of movement of the selected cells on the display.

The game is played on a gaming machine with a display; an example of the gaming machine is seen in FIG. 1. A plurality of cells is displayed on the display screen. These may be laid out as seen in FIG. 24 or configured as columns of cells as in FIG. 27 where each column contains two or more cells, for examples. These cells contain or are for holding symbols or showing a symbol from a set or plurality of symbols. The result symbol displayed in a cell is the symbol used by the controller for determining the win status of any of the games whether they be free spin games, reel spins, secondary games or primary games, for examples. Cells are grouped or categorized into two groups. These groups need not be contiguous and often are not contiguous but can be contiguous, adjacent or touching. These two groups of cells are referred to as selected cells and non-selected cells; in the case where columns are displayed, then these two groups are referred to as selected columns and non-selected columns. The members of each group may be dispersed amongst each other. For example, a selected cell may be adjacent to a non-selected cell. The selected cells represent a group of one or more cells that are selected for some particular function that is distinct from the non-selected cells; in the gaming machine where columns are displayed, the selected columns represent a group of one or more columns that are selected from some particular function that is distinct from the non-selected columns. These selected cells are useful in the secondary game for a predetermined purpose. Once the controller has chosen all of the selected cells for that round of secondary game play, the number of those selected cells remains constant throughout the secondary game play which including every free spin game associated with that round of secondary game play. The number of selected cells for the secondary game is called a quantity of selected cells. For example, if five cells are selected, then the quantity of selected cells is five throughout the secondary game, throughout every free spin game that follows the primary game which triggered the current secondary game.

While the number of the selected cells remains constant or fixed prior to the start of the secondary game, the position of those cells on the display does not need to be the same throughout the duration of the secondary game. In the case of a game using columns, the number of selected columns remains constant or fixed prior to the start of the secondary game; however, the position of those columns on the display does not need to be the same. During the secondary game, the number of selected cells is constant but the relative positional relationship between selected cells on the display can be different.

The controller chooses the selected cells also referred to as the at least one selected cell in a cell-selecting stage. The selected cells are then distinctly indicated, marked or shown in contrast to non-selected cells. This cell-selecting stage occurs between the primary and the secondary game. It may be that a second free spin game is received by the player. Furthermore, the controller determines the function of the selected cells in the secondary game.

The symbols for the game may be a composition of two other symbols in the set of symbols available in the gaming machine. For example, if one symbol is "A" and another symbol is "B", then a third symbol may be "AB" where both of the other symbols are presented on the same symbol. The composite symbol may then be displayed in the cell as symbol to be displayed in the cell.

In another embodiment the symbols in the selected cells have different shapes than those in the non-selected cells. For example, the selected cells may contain a special wild symbol that isn't available except for being present in the selected cells. Each of the selected cells can contain symbols with a different shape than any non-selected symbol. In another embodiment, the color of the selected cells is different than the color of the non-selected cells. For example, selected cells may be highlighted in blue whereas non-selected cells may be without special highlight. As another example, it may be that the selected cells are highlighted in green and non-selected cells are highlighted in red. In another embodiment, while it isn't preferred, only one cell may be selected in the cell-selecting stage. In another embodiment, more than one cell is selected in the cell-selecting stage. In another embodiment, the selected cells show a wild symbol.

In another embodiment, the primary game is a slot game where sequences of symbols are defined by reel strips. For example, one reel strip has a sequence of twenty symbols; some of those symbols may be blank; the sequence may be represented as going from symbol 1 to symbol 20; as the reel is spinning in the cell, the symbols being shown while spinning may be going from symbol 1 to symbol 20 in order and back to 1 repeating the cycle until it comes to the result symbol (for example, stopping at symbol 15).

In another embodiment, a gaming machine envisioned herein includes a display and a controller. The display shows or otherwise displays several reels in several cells. The several reels constitute a plurality of reels and the several cells constitute a plurality of cells. Each reel defines a sequence of the symbols. These symbols are selected from a set of a plurality of symbols which are available on the gaming machine. Each of those cells contains or otherwise shows a result symbol from a reel. These cells are represented as three groups: 1) a first group of selected cells; 2) a second group of selected cells; and 3) non-selected cells. Each group of the selected cells, namely the first group and the second group, has or contains at least one selected cell. In other words, at least one selected cell is in a first group and at least one selected cell is in a second group. It is preferred that the selected cells in the first group be distinct from the selected cells in the second group. The controller executes a secondary game, a free spin game, whereby each reel is spun from an initial position to a result symbol. The controller chooses the selected cells in the first group (there may be one or more than one selected cell in the first group) and chooses the selected cells in the second group (there may be one or more than one selected cell in the second group). The number of cells in the first group is indicated as a first quantity and the number of cells in the second group is indicated as a second quantity. The controller chooses each selected cell in the first group and each selected cell in the second group in a cell-selecting stage. The cell-selecting stage occurs before the secondary game, the free spin game, is executed. Each of the selected cells is distinctly indicated on the display. The first group is distinctly indicated from the second group which is distinctly indicated from the non-selected cells on the display. Thus, each of the three groups is distinctly indicated. The controller chooses the function of the cells in the first group (the first quantity may be one or more) and the function of the cells in the second group (the second quantity may be one or more) in the free spin game. The controller also determines the outcome of the secondary game, the free spin game or each free spin game if more than one was part of the secondary game. The first quantity and the second quantity remain constant until the free spin game ends. The secondary game as a free spin game may encompass any number of individual free spin games or reel spins initiated by the controller as part of that game play following the game which triggered the secondary game.

In another embodiment, the selected cells in the first group can change position on the display. It may also be the second group of selected cells can change position on the display or that they remain in the same place while the first group changes position. In another embodiment of the gaming machine envisioned, the symbols in both the first group and the second group remain unchanged in subsequent reel spins associated with the secondary game, or a free spin game following the first reel spin. However, it could also be the case that the symbols in only one of the groups remain unchanged or that the symbols in both the first and second group change. The number of selected cells in the first group and the number of cells in the second group each remain constant throughout the round of free spin games or reel spins of the secondary game. The secondary game may have multiple reel spins allowed by the gaming machine in the current disclosure. In another embodiment, selected cells in the second group, the at least one selected cell in the second group, change position on the display during the secondary game. In another embodiment, at least one symbol is a composition of at least two other symbols in the plurality of symbols. In another embodiment, the first quantity, the quantity of selected cells in the first group, is greater than one. In another embodiment, the second quantity, the quantity of selected cells in the second group, is greater than one. However, it could also be that both the first and the second quantity are greater than one or that both the first and the second quantity are equal to one. In another embodiment, each selected cell in the first group displays a wild symbol and each selected cell in a second group displays a wild symbol.

In one embodiment, a gaming machine is provided with a display and a controller. The display shows a plurality of reels in a plurality of cells. The reels specify a sequence of symbols in which each symbol is selected from a plurality of symbols. Each cell displays or contains a result symbol from one of the plurality of reels. The plurality of cells is composed of non-selected cells, selected cells in a first group and selected cells in a second group. The controller executes a secondary game, a free spin game where each reel is spun from an initial position to a result symbol. The controller chooses the selected cells in the first group (referred to as the at least one selected cell in a first group). The number of cells chosen in the first group is referred to as a first quantity of selected cells. The controller chooses the selected cells in the second group (referred to as the at least one selected cell in a second group). The number of cells chosen in the second group is referred to as a second quantity of selected cells. The controller chooses each of the cells in the first group and the second group in a cell-selecting stage before the free spin game is executed. Each of the groups of cells, the non-selected cells, the first group of selected cells, and the second group of selected cells are distinctly indicated on the screen one from another. The first group which is indicated on the display, and the second group which is indicated on the display are distinctly indicated from each other; both of these groups, the first group of selected cells and the second group of selected cells, are distinctly indicated from the non-selected cells. The controller chooses the function of the first group of selected cells and the function of the second group of selected cells for the secondary game which may have multiple free spins or reel spins; that is, the controller chooses the function of the selected groups for the purpose they will perform in the free spin game. The controller determines an outcome of the secondary game or the free spin game. A distinguishing feature being that the first quantity and the second quantity remain constant for the duration of the secondary game, that is, for every reel spin associated with that secondary game. The first quantity and the second quantity do not change for each reel spin in the secondary game.

In another embodiment, the selected cells in the first group can change position on the display. The selected cells in the second group can also change position on the display in subsequent reel spins of the secondary game. It could also be that both the selected cells in the first group and the selected cells in the second group change position in subsequent reel spins of the secondary game. In another embodiment of the gaming machine envisioned, the symbols in both the first group and the second group remain unchanged in subsequent reel spins associated with the secondary game following the game which triggered the free spin game of the secondary game. However, it could be that the symbols in one or both of the selected groups change in a second reel spin of the secondary game. In another embodiment, the first group of selected cells has a first symbol in each of the cells of the first group (the at least one selected cell in the first group); the second group of selected cells has a second symbol in each of the cells of the second group (the at least one selected cell in the second group); the second symbol, which is the symbol in the second group, is different than the first symbol, which is the symbol in the first group. In another embodiment, at least one symbol is a composition of at least two other symbols in the plurality of symbols. In another embodiment, the first quantity is greater than one. In another embodiment, the second quantity is greater than one. It could also be that both the first quantity and the second quantity are equal to one or that both the first and the second quantity are greater than one. In another embodiment, each selected cell in the first group displays a wild symbol and each selected cell in a second group displays a wild symbol.

In one embodiment of the current disclosure, a gaming machine that includes a primary game and a secondary game where the secondary game is initiated by an event of the primary game is provided for. The gaming machine includes a display and a controller. The display shows a plurality of columns where each column contains a plurality of cells. Each cell contains a symbol from a plurality of symbols. The plurality of columns is composed of non-selected columns and selected columns. The selected columns are referred to as the at least one selected column. The number of selected columns represents the quantity of selected columns. The quantity of selected columns remains constant until the secondary game ends. There may be multiple games played in the secondary game as determined by the gaming machine in that round of the secondary game. The controller chooses the selected columns which are referred to as the at least one selected column in a column-selecting stage between the primary game and the secondary game. The selected columns are distinctly indicated on the display from the non-selected columns. The controller chooses the function of the selected columns in the secondary game; the controller chooses the function of the selected columns for a specified purpose or function for use in the secondary game.

In another embodiment of the gaming machine where one or more columns are selected, the selected columns change position during the secondary game. In yet another embodiment of column selecting version of the gaming machine, the primary game is a slot game conducted using reels.

FIG. 1 is a perspective view showing an example of a gaming machine of the present invention. This gaming machine 1 is designed as a video slot machine. As shown in FIG. 1, the gaming machine 1 is provided with two displays 2. Immediately under the displays 2, there are provided BET switches 4, selection switches 5, a MAXBET switch 6, a PAYOUT switch 7, a coin slot 8, a bill acceptor 9 and a spin button 11. The BET switches 4 are provided for selecting a wager per pay line and in this embodiment include five switches from 1BET to 5BET. The selection switches 5 are provided to determine how many pay lines should be active in each slot game and in this embodiment include five switches from 10LINE to 50LINE. A coin payout mouth 10 is provided in the lower part of gaming machine 1. The spin button 11 may be used to start a slot game executed in the gaming machine. The above-mentioned components equipped in the gaming machine 1 may be used to execute a primary game and a secondary game on the display. The display on the gaming machine may be a video display screen as useful for a video version of the gaming machine of the current disclosure.

The "primary game" used in this specification means a game initiated on a gaming machine at first after the gaming machine receives a bet from a player and also a game most frequently executed in an entire game executed by the gaming machine. In general, the primary game may be any game such as a slot game, a poker game or a roulette game. The primary game is a game that is played prior to the controller implementing the secondary game. The primary game is the trigger for the secondary game. The controller determines to initiate a secondary game or free spin game by, some event, some occurrence, or some symbol, in other words some predetermined condition, in the primary game or otherwise triggering game. The gaming machine may be configure to recognize the predetermined condition for executing a secondary game by an event in the primary game based on the result of the game, for example, a win. It may also be that the gaming machine is configured to execute a secondary game as a result of the predetermined condition in the primary game regardless of a win, loss, or some other outcome of the primary game.

The "secondary game" used in this specification means a game secondly executed in an entire game executed in the gaming machine when a predetermined condition is satisfied. Whether the predetermined condition is satisfied or not may depend on a result of a primary game or may not depend on the result of the primary game. The gaming machine used in game businesses in recent years is likely to be configured to be able to execute the primary game and the secondary game. The secondary game is generally executed in order to provide a bonus to the player and therefore, it may be called "a bonus game". Thus, an award of the secondary game is generally higher than that of the primary game on average. The probability of winning the secondary game is generally higher than that of winning the primary game. The secondary game may be configured to the same kind of game as the primary game. For example, slot games may be executed both as the primary game and as the secondary game. Alternatively, the secondary game may be configured by a different kind of game from the primary game. Typically, the secondary game is a free game, i.e., executed without receiving a bet from a player.

The displays 2 are adapted to display information required by the player to play a game. For example, such information may include symbols used in the slot game, selected wager per pay line, activated pay lines, etc. The information may also include an indication to prompt a player to make certain choices in a progressive game if the gaming machine 1 is adapted to provide a progressive game. The "progressive game" is a game having a progressive award which is gradually updated according to a player's bet. In general, the progressive game has some kinds of progressive awards, and one of the progressive awards is selected to pay out to a player if the player wins the game. In such a case, the displays 2 may also display the amount of each kind of progressive awards that the player has a chance to obtain. Moreover, information that corresponds to a status of the progressive game, a credit that the player has input into the gaming machine 1, and play history of the player may be displayed on the displays 2. It should be noted that in general, the information provided by the displays 2 can change depending on the game that the gaming machine 1 provides. For example, if the gaming machine 1 is adapted to provide a card game, the information may include images of cards, and if the gaming machine 1 is adapted to provide a roulette game, the information may include an image of the roulette.

As mentioned above, the BET switches 4 are switches for inputting a wager in each game. As is well known, if one credit (or unit of bet) is 5 cents, for example, the player can select 5 cents/line by pushing 1BET switch, and 10 cents/line by pressing 2BET switch, and so on. The selection switches 5 are switches that can be used for determining how many pay lines should be active in each slot game, as mentioned above. However, the switches 5 may also be used to select a card or cards, which the player wants to discard, in the case where the gaming machine 1 provides a card game (in the porker game, for example, 10LINE switch may be used to indicate the left-end card to be discarded, 20LINE switch may be used to indicate the card on the right of the left-end card, and so on.). The number of BET switches 4 and selection switches 5 may not be limited to five, but may be any suitable number. The gaming machine 1 may additionally have a switch for casting a bet as an extra bet.

The MAXBET switch 6 is a switch for inputting the maximum bet that a player can spend at a time in a single game. The PAYOUT switch 7 is a switch to be operated by the player when the player wants to quit the game and collect the amount of money which has been credited onto the gaming machine 1. The coin slot 8 is a hole for receiving coins as credit for playing the games. The bill acceptor 9 is a hole used to accept a bill or a cash card as credit for playing the games, or to pay out the amount of money, which has been credited in the gaming machine 1, to the player. The coin payout mouth 10 is a tray to pay out a player the amount of money which has been credited in the gaming machine 1.

The gaming machine 1 related to the present invention is not limited to the above, but it may have other various functions, and/or some of the above-mentioned functions may be omitted. For example, the gaming machine 1 may have a lighting apparatus for providing illumination in a color or a plurality of colors when the player proceeds into the bonus game or secondary game, for example. The gaming machine 1 may also have an apparatus for outputting music or any other sound and/or an apparatus for vibrating the whole gaming machine, when the player proceeds into the secondary game, for example. The gaming machine 1 may have three or more displays or only a single display. The gaming machine 1 may have a REPEAT switch for choosing the bet per line and number of activated pay lines that the player selected in the last game again.

Reels, roulette, etc., which are used in the game, may not necessarily be those displayed on the display. A stepper (mechanical reels), mechanical roulette, etc. may be mounted in the gaming machine 1 instead of or in addition to images of the reels, roulette, etc. There may be a display etc., which is used in a plurality of gaming machines in common.

Figure 2:
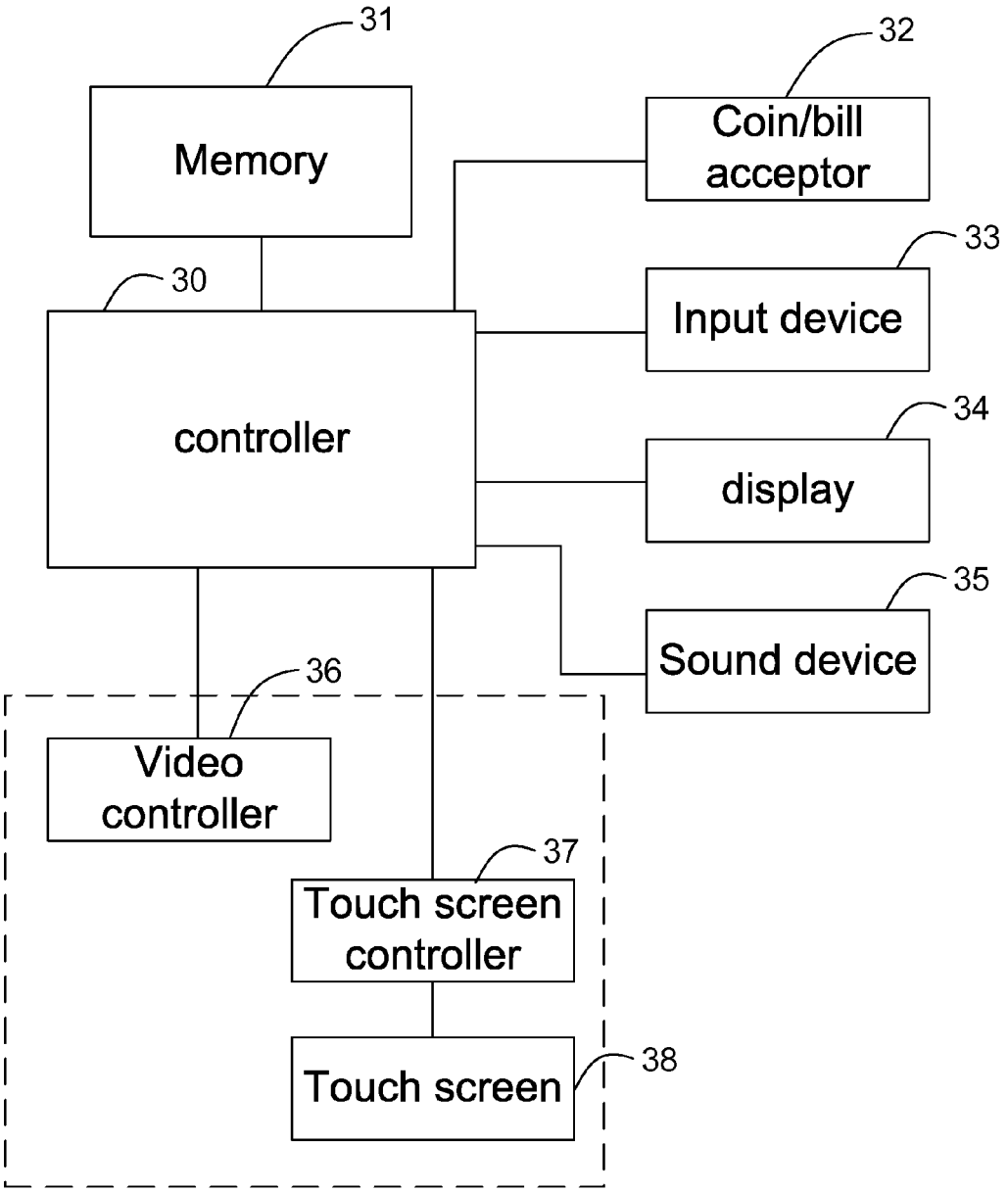
FIG. 2 is a block diagram illustrating an example of a gaming machine of the present invention.

FIG. 2 is a block diagram illustrating an example of an operational structure of the gaming machine 1 of the present invention. The gaming machine 1 is configured with a controller 30, a memory 31, a coin/bill acceptor 32, an input device 33, a display 34, a sound device 35, a video controller 36, a touch screen controller 37 and a touch screen 38. The memory 31 stores information regarding a game status, a game program and data. The coin/bill acceptor 32 equipped as the coin slot 8 and the bill acceptor 9 of FIG. 1 receives a coin or a bill from a player. The input device 33, which is equipped as the BET switches 4, the selection switches 5, the MAXBET switch 6, the PAYOUT switch 7 and the spin button 11 of FIG. 1, receives an operation from the player and transmits the operation to the controller 30. The display 34 corresponding to the display 2 in FIG. 1 indicates information regarding a game. The sound device 35 can be used to make a sound to excite the player. The video controller 36 may be used to process a game image to be displayed on the display 34. The touch screen controller 37 controls the touch screen 38, which can be disposed over the display 2 in FIG. 1 to receive an operation from the player. The controller 30 is connected to the memory 31, the coin/bill acceptor 32, the input device 33, the display 34, the sound device 35, the video controller 36 and the touch screen controller 37, to process information received from these component parts and control them to carry out the game provided by the gaming machine 1.

Next, an operation of the gaming machine 1 of the present invention will be explained with respect to a preferred game executed by the gaming machine 1. The game to which the present invention may be applied is typically configured as a slot game including a primary game and a secondary game in which symbols are shown in a plurality of cells or columns. According to the present invention, a cell-selecting stage or a column-selecting stage is performed during the period between the primary game and the secondary game. Details of the present invention will be described below with reference to exemplary game screens shown in the drawings.

Figure 3:
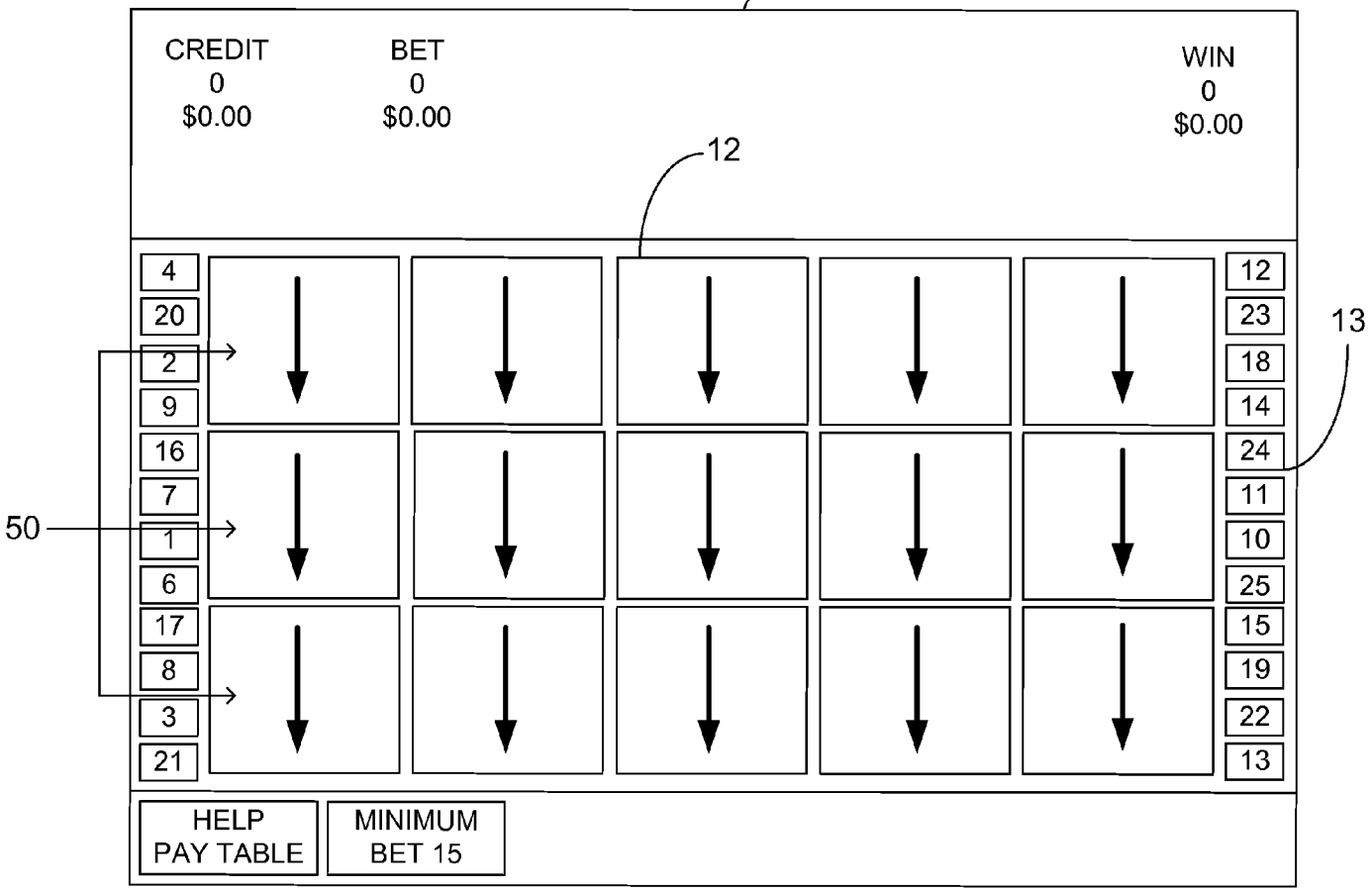
FIG. 3 is a diagram illustrating a state of an exemplary game executed by the gaming machine pertaining to the present invention.

One embodiment of the game, which is executed by the gaming machine 1 pertaining to the present invention, is illustrated in FIGS. 3-7. FIG. 3 illustrates a game screen during the primary game executed by the gaming machine 1, which in this embodiment is a video slot machine. In FIG. 3, each of fifteen cells 12 having a rectangular shape is indicated on the display 2. The cells 12 are arranged in a 3×5 matrix and three of those cells 12 aligned in a vertical direction of the drawing configure a column 50. In this embodiment, each of the cells 12 has an image of a reel (which may be called a virtual reel or simulated reel) therein. The virtual reel is associated with or configured by a virtual reel strip along which symbols are arranged. In other words, each virtual reel has predetermined symbols stop positions like physical reels. When the controller 30 receives instructions from the player to start the slot game, the controller 30 starts a primary game. In the primary game, the controller 30 controls the display 2 to rotate the reels in the cells 12 on the display 2, as indicated by downward arrows in FIG. 3. It should be noted that this may be also expressed as "the controller 30 rotates the symbols" in this specification. The rotation of symbols continues for a while but will eventually stop and a symbol is displayed on each cell 12. In this embodiment, the cells 12 are independent from each other, which mean that the stop position and resulting symbol for the reel in each cell 12 is randomly decided by the random number generator independently from the others.

Figure 4:
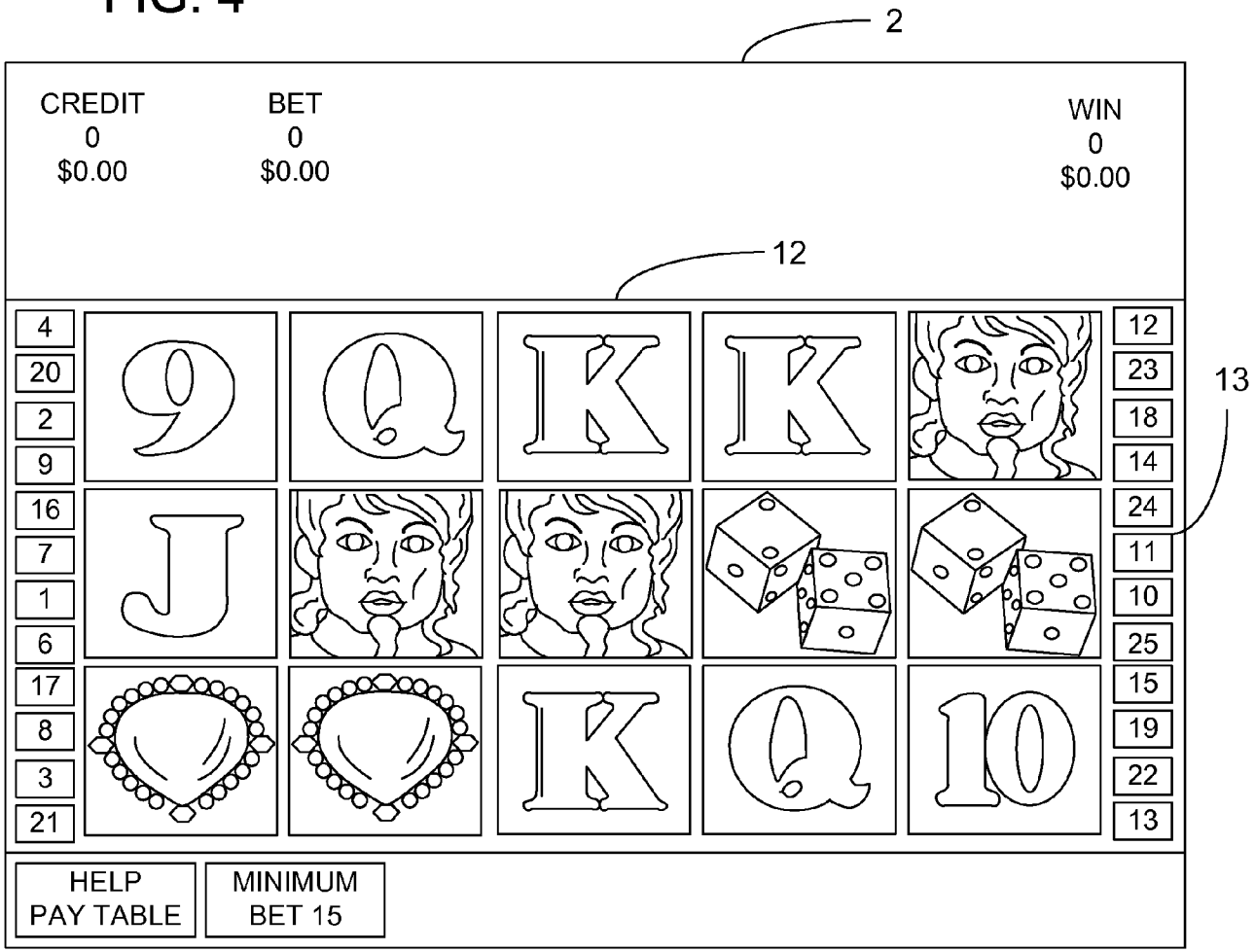
FIG. 4 is a diagram illustrating a state where a game situation shown in FIG. 3 has progressed further.

FIG. 4 illustrates a state where the symbols shown in FIG. 3 have stopped rotating and a symbol is displayed on each cell 12. Then, whether a prize should be paid out or not is determined by determining whether these symbols form one or more winning combinations on pay lines 13. Further, it is determined whether or not a predetermined condition for starting a secondary game is met. For example, such a predetermined condition may be that a winning combination is formed on at least one of predetermined pay lines 13 at the time when the symbols stopped rotating, or that more than one predetermined symbol are displayed on the cells 12 (such a predetermined symbol may be called a "scatter symbol", "bonus symbol", "bonus trigger symbol" or a "bonus feature symbol"). The predetermined condition for starting the secondary game may not be related to the outcome of the primary game. When it is found that the predetermined condition is met, the controller 30 executes a cell-selecting stage before starting the secondary game.

Figure 5:
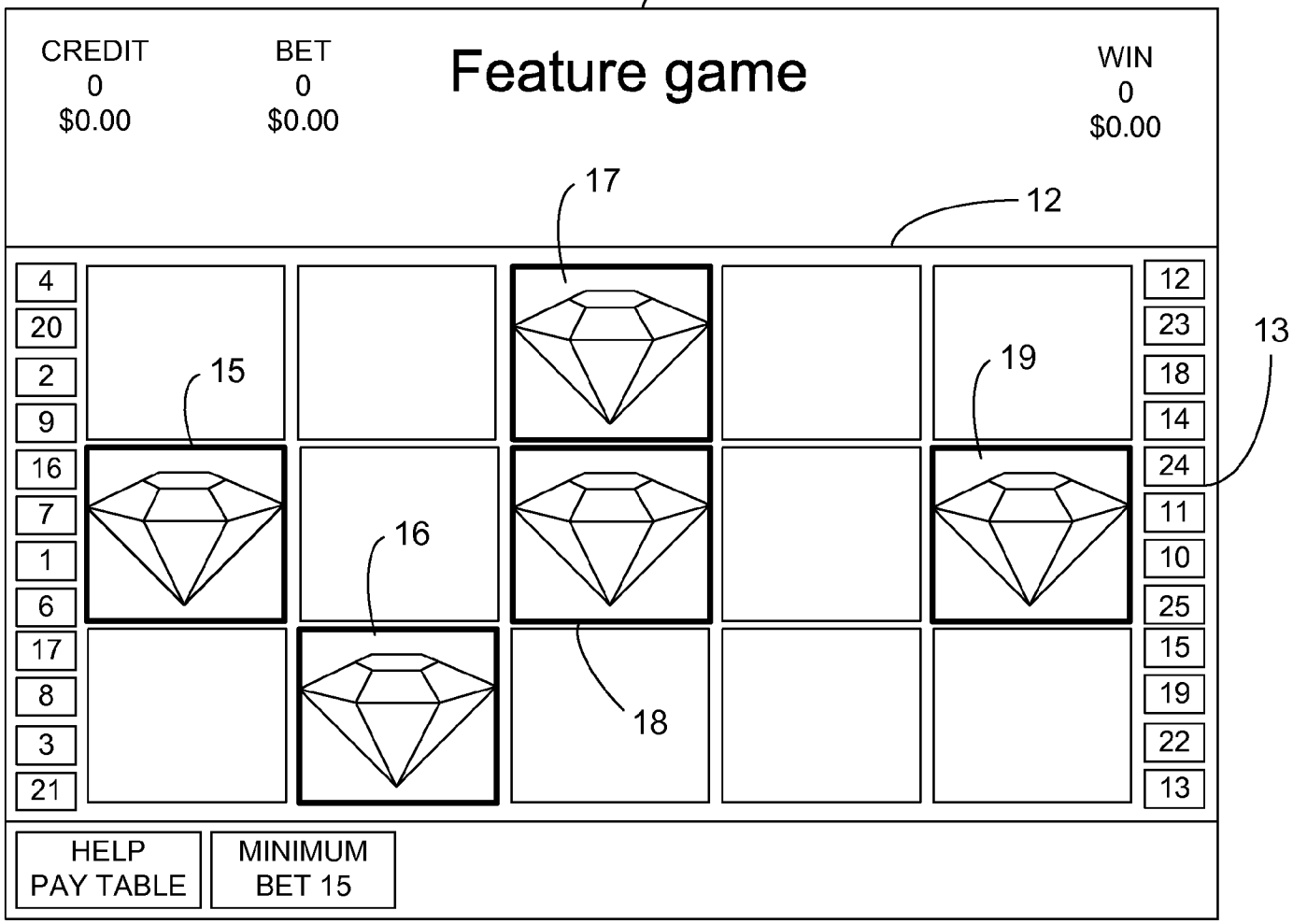
FIG. 5 is a diagram illustrating a state where a game situation shown in FIG. 4 has progressed further.

FIG. 5 illustrates a state where the controller 30 is executing the cell-selecting stage. In the cell-selecting stage, normally, the controller 30 randomly selects one or more cells 12 based on a random number at first. When the cell or cells are selected, the controller 30 displays a certain indication on the selected cell or cells. For example, a predetermined symbol (diamond symbol in FIG. 5) may be displayed in the selected cell or cells. In FIG. 5, cells 15-19 are the selected cells. A player is able to recognize the selected cells by seeing the diamond symbols displayed in the cells 15-19. On the other hand, there may be no indication in the cells which were not selected by the controller 30. The predetermined symbol may be such a symbol that is not used in the primary and/or secondary games. In other words, the reel strip used in the cell selection stage may have a different symbol sequence from the reel strips for the primary and/or secondary games. Further, instead of or in addition to showing a predetermined symbol in the selected cells, other methods for indicating the selected cell may be adopted. Such a method may include showing the boundary of the selected cell in a different color from that of the non-selected cells or showing the symbol in the selected cell with a background having a different color from that in the non-selected cells, for example.

As another method for the cell-selection, the game may be set up so that a player is allowed to select the cells. For example, when the player touches the cells on the display 2, the touch screen 38 recognizes the touch and sends an electric signal to the controller 30 through the touch screen controller 37. The controller 30 may be arranged to receive the electric signal to select the cells 12, which were specified by the player.

In the above cell-selecting stage, the number of cells 12 selected in the selecting stage may be any number not exceeding the number of the entire cells. However, in order to make the game more exciting, it is preferred to select a plurality of cells 12. Also, the controller 30 may be adapted to proceed to the secondary game without selecting a cell 12 in the cell-selecting stage with a certain probability. If no cell has been selected, the executed secondary game will be no different from the conventional one.

In the case where the controller 30 selects a plurality of cells 12, preferably, the controller 30 selects about ¼-¾ of the entire cells 12. More preferably, the controller 30 selects about ⅓-⅔ of the entire cells 12. This is because when the number of the selected cells is too small or too large (i.e., less than ¼ or more than ¾ of entire cells 12), it may become hard for the player to recognize the selected cells 12.

The number of the cells 12 displayed on the display 2 may not be limited to 15 but can be any number. The cells 12 can be arranged in any matrix such as "3×3", "3×4", "3×5", "4×5", or "5×5", for example. Further, the cells 12 may not be necessarily arranged in a matrix pattern but may be arranged in any pattern. For example, the cells 12 may be arranged to form five columns such that the first, third and fifth columns from the left each contain three cells 12 while the second and fourth columns each contain four cells 12. In this case, the cells 12 are not arranged in line in a horizontal direction (i.e., in a direction perpendicular to an extension of columns). Further, the shape of the cells 12 may not be limited to the rectangular shape, but may be of any shape such as circle, square or any other polygonal shape.

In the above-mentioned cell selecting stage shown in FIG. 5, the predetermined symbol may also be lit up on the selected cells 12. Also, the display of the predetermined symbol in the selected cells 12 may be conducted together with some visual and/or audio effects to make the cell-selection more impressive to the player. For example, an illumination device may be provided to the gaming machine 1 to generate a color light when the predetermined symbol is displayed on the selected cell 12. Alternatively or in addition, the sound device 35 equipped to the gaming machine 1 can produce appropriate sounds when the predetermined symbol is displayed on the selected cell 12.

The above-mentioned cell-selecting stage is not limited to taking place only one time between the primary game and the secondary game. For example, if the secondary game is a free spin game, a plurality of reel spins may be performed in the secondary game. In this case, the above-mentioned cell-selecting stage may be performed every time before conducting each reel spin in the secondary game. The cells selected before conducting a reel spin may show the same symbols or mutually related symbols in the reel spin until the next cell-selecting stage is started before the next reel spin.

In a case when the above-mentioned cell-selecting stage is executed a plurality of times, the number of the cells to be selected may differ from the number of the cells selected last time in the previous cell-selecting stage. For example, the number of the cells selected may change for every cell-selecting stage, or the number of the selected cells may increase compared with the selected cells in the previous cell-selecting stage. The above-mentioned cell-selecting stage may be executed any time, such as at a stage before or while the primary game is executed.

By the way, in the present specification, the cell-selecting stage may be referred to as "a feature game". The "feature game" used in this specification means a game executed between the primary game and the secondary game.

Figure 6:
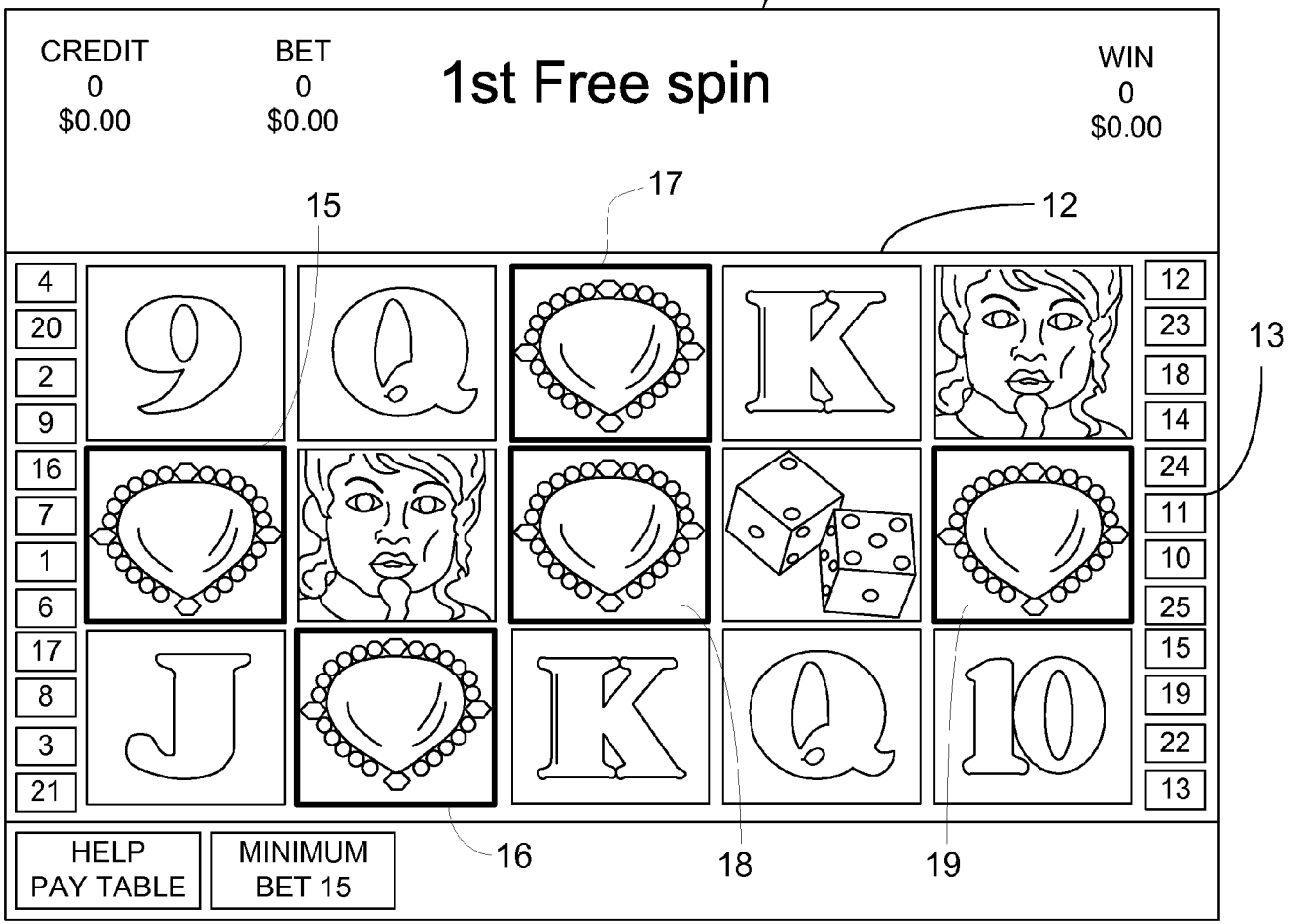
FIG. 6 is a diagram illustrating a state where a game situation shown in FIG. 5 has progressed further.

FIG. 6 is a diagram illustrating a state where a game situation shown in FIG. 5 has progressed further. FIG. 6 illustrates a state where the controller 30 is executing a free game as the secondary game.

The "free game" used in this specification means a game executed on a gaming machine without receiving a bet from a player. When the free game is a slot game or a series of slot games (or reel spins), the game may be called a "free spin game" or "free spin". The term "free spin game" or "free spin" basically refers to an entire game including the plurality of reel spins but may sometimes refer to each one of the plurality of reel spins, and thus the meaning of the "free spin game" or "free spin" may change depending on the context of the specification. When the free spin game is conducted, an amount of award resulting from symbol indication is computed for every reel spin and a total amount of those awards is eventually paid out to the player. The number of the reel spins may be increased or decreased during the free spin game according to a predetermined condition.

In the free spin game of this embodiment, a plurality of free slot games is automatically conducted. FIG. 6 shows a state at the time when the controller 30 has stopped the rotation of symbols in the first one (1st Free spin) of such plurality of free slot games of the free spin game. According to the present invention, in the secondary game, a predetermined function is provided to the cells selected in the cell-selecting stage (or feature game). In the embodiment shown in FIG. 6, the same "jewelry symbols" are displayed on cells 15-19 selected in the feature game. Thus, the same symbols or the related symbols with each other are displayed on the selected cells 15-19.

Figure 7:
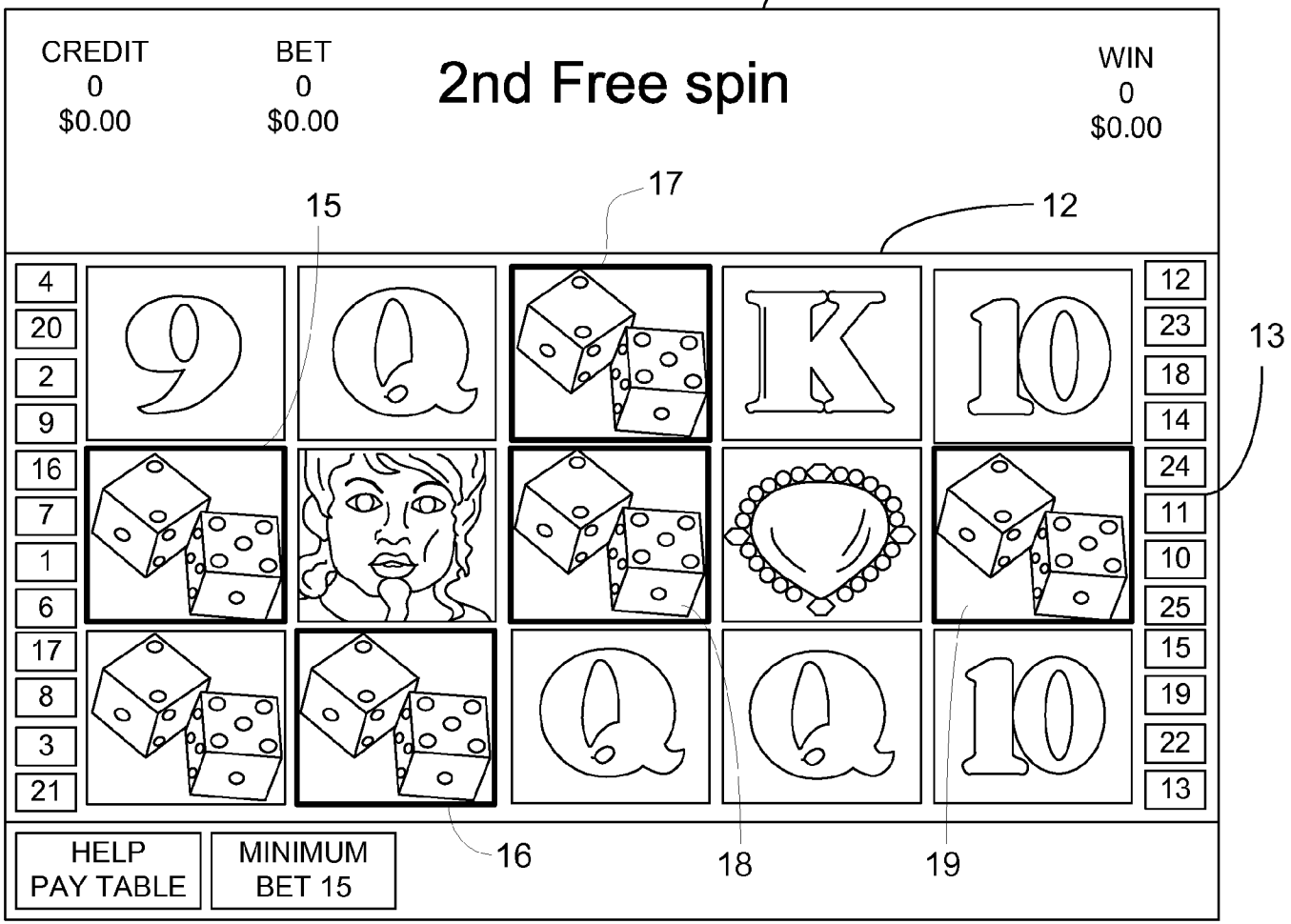
FIG. 7 is a diagram illustrating a state where a game situation shown in FIG. 6 has progressed further.

FIG. 7 is a diagram illustrating a state where the game situation shown in FIG. 6 has progressed further. A state after the controller 30 has performed the rotation of symbols in the second free slot game (2nd Free spin) in the free spin game is illustrated in FIG. 7. In the same fashion as in FIG. 6, the same symbols are displayed on the cells 15-19 selected in the feature game in FIG. 7. However, in FIG. 7, "dice symbols" are displayed on the selected cells instead of the "jewelry symbols". The symbol rotation of third free slot game onward of the free spin game is executed in the similar manner as mentioned above. Different symbols may be displayed in the selected cells for different free slot games in the free spin game, such as the "jewelry symbols" for the first free slot game and the "dice symbols" for the second free slot game, as described above. Alternatively, the same symbol may be displayed for different free slot games in the free spin game, such as the "jewelry symbols" for both of the first and second free slot games.

Figure 8:
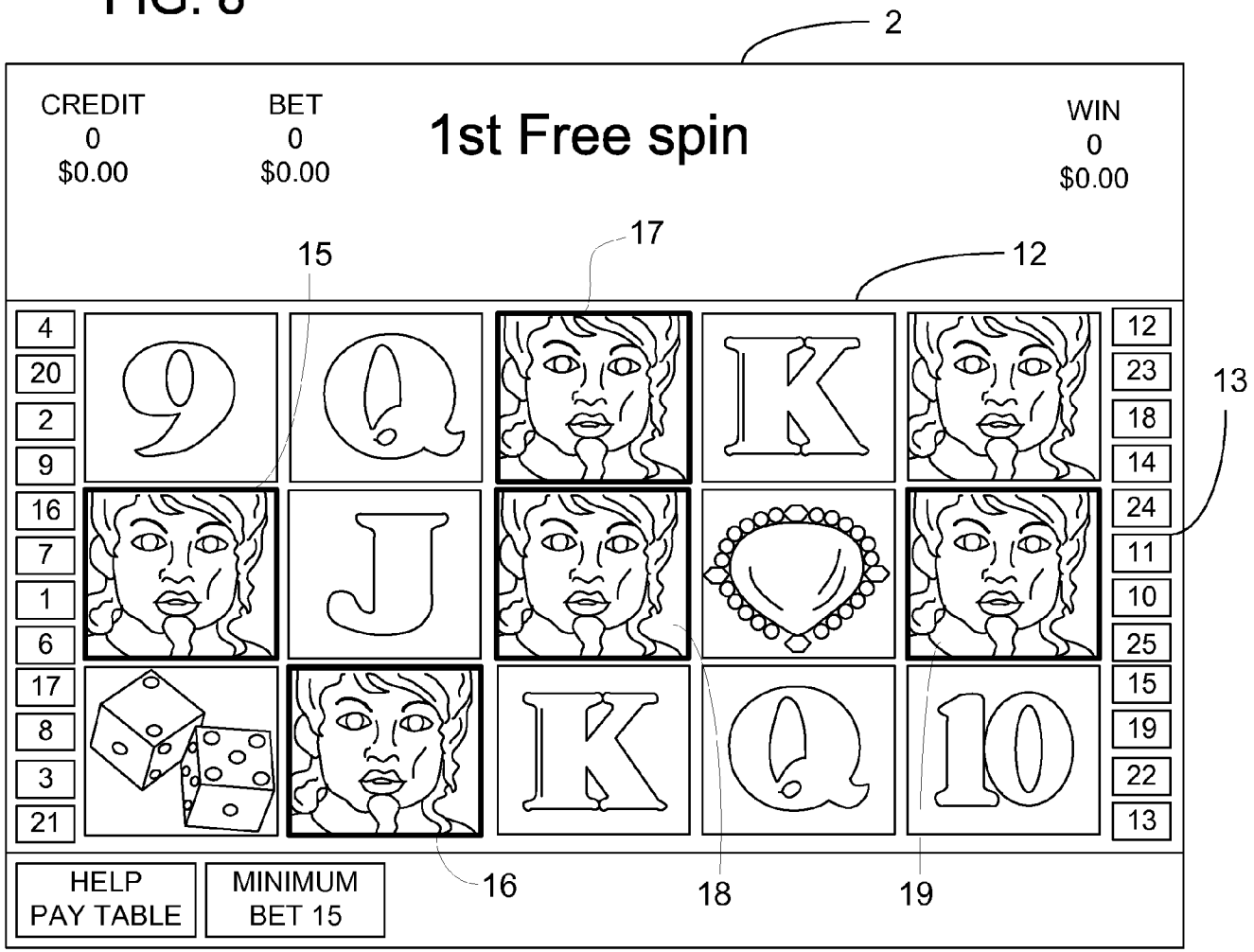
FIG. 8 is a diagram illustrating another example of a game executed by the gaming machine pertaining to the present invention.
Figure 9:
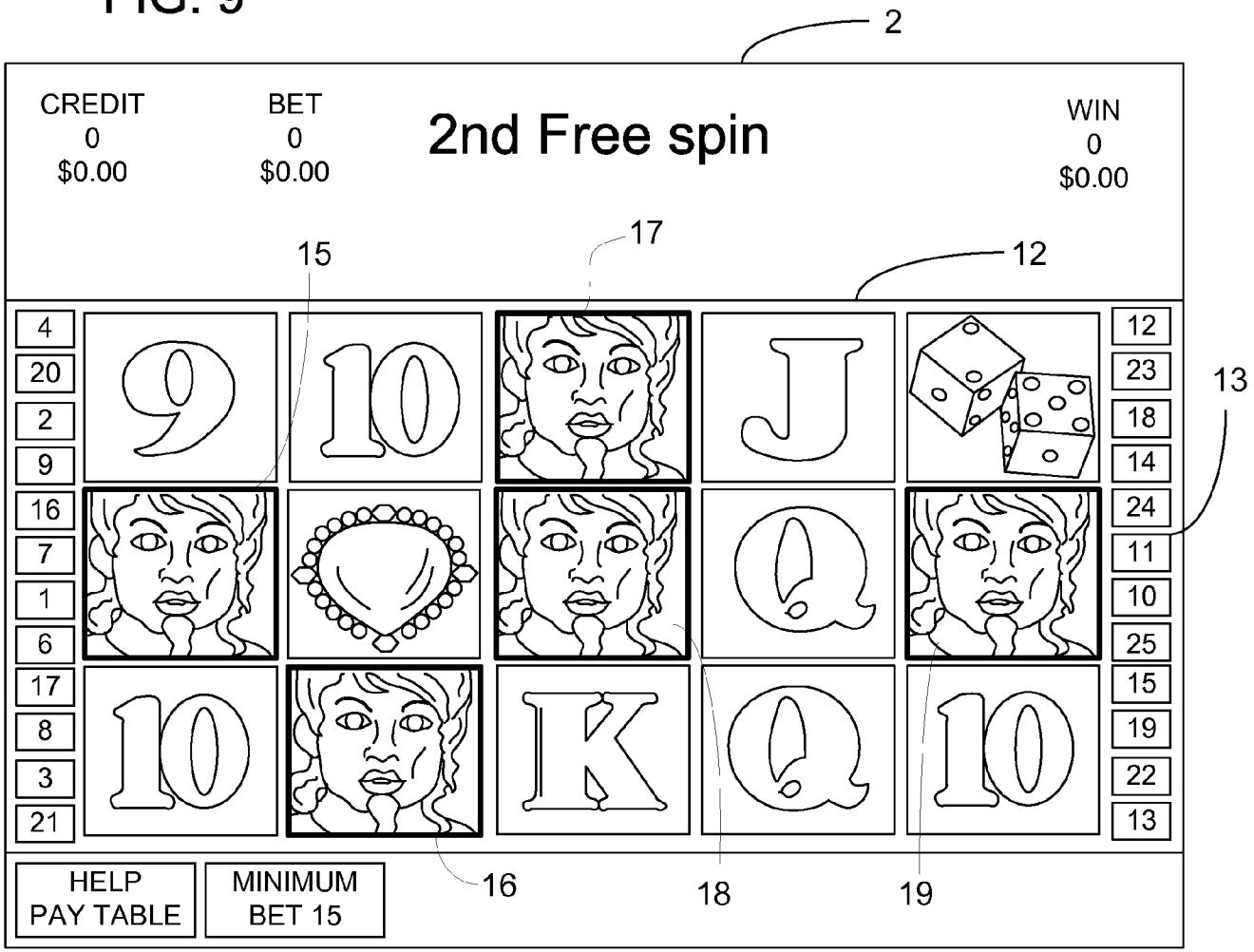
FIG. 9 is a diagram illustrating a state where a game situation shown in FIG. 8 has progressed further.

Next, another embodiment of the game, which is executed by the gaming machine pertaining to the present invention, will be described in reference to FIGS. 8 and 9. FIGS. 8 and 9 also illustrate a free spin game as the secondary game. The cells 15-19 are the cells selected in the feature game. FIG. 8 illustrates a state in which the controller 30 has stopped the symbol rotation after rotating the symbols for the first free slot game (or 1st Free spin) in the free game. In this embodiment, the free spin game is designed such that only the wild symbols (in this embodiment, indicated by a figure of a woman face) are displayed on the selected cells. Therefore, as shown in FIG. 8, the wild symbols are displayed on all of the selected cells 15-19.

FIG. 9 illustrates a state after the controller 30 has performed the symbol rotation for the second free slot game (or 2nd Free spin) in the free game. Also in this figure, the wild symbols are displayed on all of the selected cells 15-19. That is because the free spin game is designed so that symbols other than the wild symbols may not be displayed on the selected cells. Thus, the game can be set up so that the wild symbols are displayed on the selected cells throughout the entire free spin game.

Figure 10:
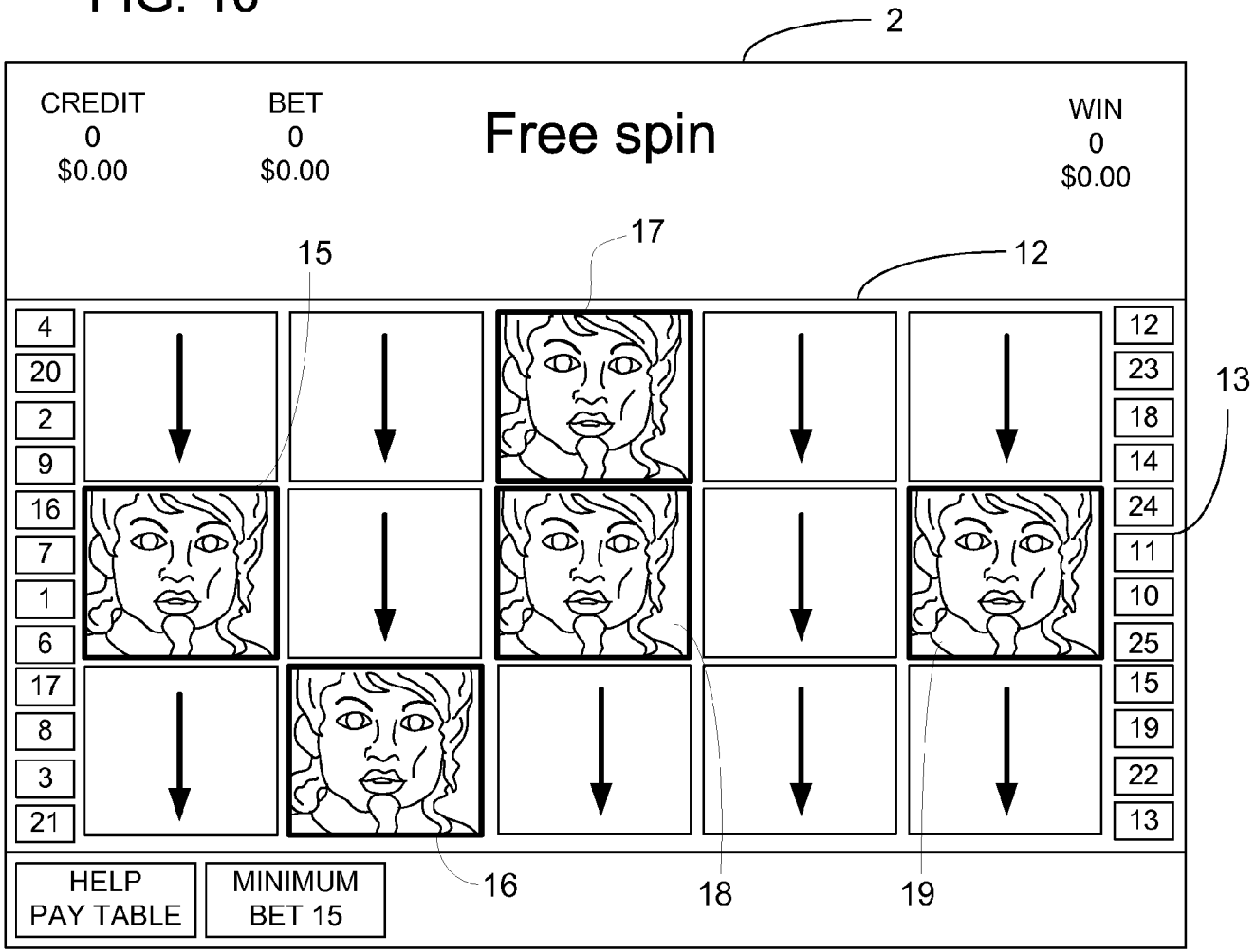
FIG. 10 is a diagram illustrating yet another example of a game executed by the gaming machine pertaining to the present invention.
Figure 11:
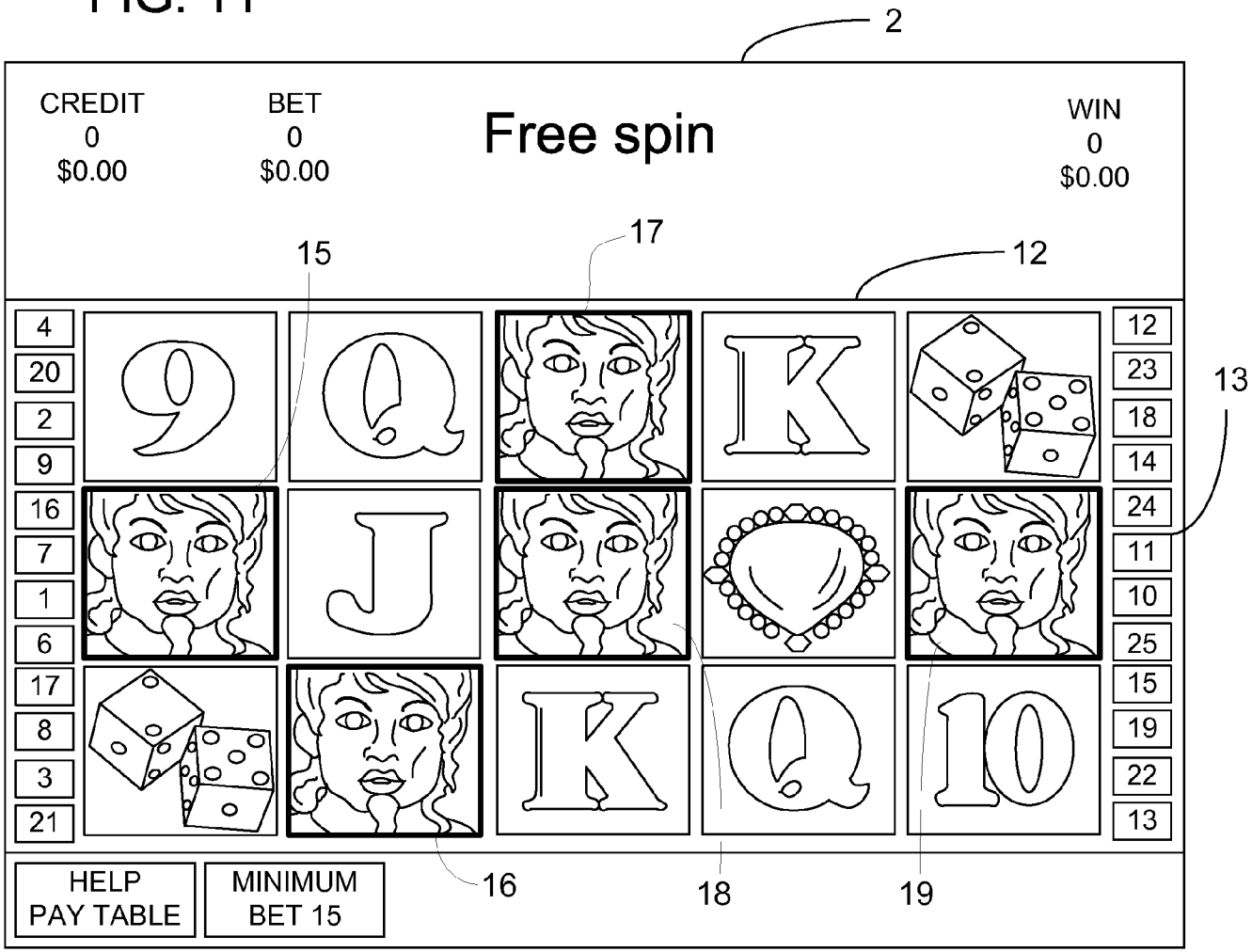
FIG. 11 is a diagram illustrating a state where a game situation shown in FIG. 10 has progressed further.

Next, another embodiment of the game, which is executed by the gaming machine pertaining to the present invention, will be described in reference to FIGS. 10 and 11. FIGS. 10 and 11 also illustrate a free spin game. In this embodiment, as well as the above-described embodiments, the cells 15-19 are the cells selected in the feature game. FIG. 10 illustrates a state where the controller 30 has stopped the symbols in each cell once, and then, further rotates the symbols in the non-selected cells after the wild symbols are displayed on the selected cells 15-19. The symbol rotations in the non-selected cells are shown by downward arrows in FIG. 10. In FIG. 10, the symbols in the selected cells 15-19 are not rotating, and the wild symbols are displayed steadily on the selected cells 15-19. Then, subsequently, the controller 30 stops the symbol rotation on the non-selected cells and the display 2 may be in the state illustrated in FIG. 11. As shown in FIGS. 10 and 11, when performing the free spin game using the selected cells, the symbols displayed on the selected cells may not rotate, and may be fixedly displayed continuously. The free spin game may be executed by rotating and displaying the symbols displayed on the cells other than the selected cells.

As described above, a cell-selecting stage is provided before the controller 30 starts the secondary game (for example, a free spin game). According to the present invention, the selected cell(s) are given a predetermined function. In one preferred embodiment, the controller 30 displays a predetermined symbol on the selected cell(s). The symbol, which the controller 30 displays on the selected cell(s), may be any symbol. For example, the symbol on the selected cell(s) may be a special symbol, such as a wild symbol or a scatter symbol. In another example, the symbols, which the controller 30 displays on the selected cells, may be special symbols that are not used in the primary game. What the special symbols are may be decided based upon a game designer's discretion. For example, the special symbol may be a picture symbol "A" that does not appear in the primary game. In another example, the symbols displayed on the selected cells may be related to each other. Further, the symbols displayed on the selected cells may be the same with each other. On the other hand, the symbols displayed on the cells which the controller 30 did not select may be determined by the controller 30 so as to achieve a predetermined payout rate.

The "symbols related to each other" here refers to symbols having a relation, which a game designer arbitrarily defined, with the other symbol. The relation is not only limited to a case of two or more symbols having a common characteristics or attribution. That is, for example, a case where two or more symbols have a common appearance, a common attribution, etc., such as a "number", the "alphabet", etc., is not the only case that is included in "the related symbol" here. Two or more symbols, which have the relation that a game designer arbitrarily defined, are included in the "related symbols" here.

Examples of the "related symbols" will be described below. For example, there are cases where only the high reward symbols are displayed on the selected cells, where only the low reward symbols are displayed on the selected cells, where only the symbols, which have a special function, are displayed on the selected cells, where only the symbols, which are capable of increasing the number of free games, are displayed on the selected cells, where only the symbols, which have a function to payout an additional reward, are displayed on the selected cells, etc. The high reward symbols and the low reward symbols may be decided based upon designer's discretion. For example, the high reward symbols may be symbols to compose the first highest reward or the second highest reward. The low reward symbols may be symbols to compose a reward except for the first highest reward or the second highest reward.

As mentioned above, the free spin game is a game that is usually positioned as a bonus game, and may comprise a plurality of reel spins. In the above embodiments shown in FIGS. 3-11, the cell-selection stage was provided before entering the free spin game, and the selected cells 15-19 were the same for different reel spins in the free spin game. However, the execution of the above-mentioned cell-selecting stage is not limited to one time before the free spin game. For example, the cell-selecting stage may be provided between every adjacent reel spins of the free spin game. In each reel spin, the same or the related symbols may be displayed on the cells selected in the immediately preceding cell-selecting stage. Also, the number of cells selected in the cell-selecting stages may differ from one cell-selecting stage to another. For example, in a case where the cell-selecting stage is executed two times (two cycles) in the free spin game, three cells may be selected in the cell-selecting stage in the first cycle and two cells may be selected in the cell-selecting stage in the second cycle. The above-mentioned cell selecting stage may be executed for any number of times in the free spin game. The free spin game may be interrupted by the cell-selecting stage any number of times. If the cell-selecting stage is executed many times in the free spin game, the game can be made more active.

In a case when the reel spins (or symbol spins) in the free spin game is to be executed many times (for example, 20 times or more, or 30 times or more), it is preferable to execute the above-mentioned cell-selecting stage in between the symbol spins in the free spin game. In a case when the above-mentioned cell-selecting stage is executed a plurality of times, the cells which differ from the last selected cells in a previous cell-selecting stage may be selected. In a case when the above-mentioned selecting stage is executed a plurality of times, the symbols which differ from the last selected symbols in a previous cell-selecting stage may be displayed on the cells.

Figure 12:
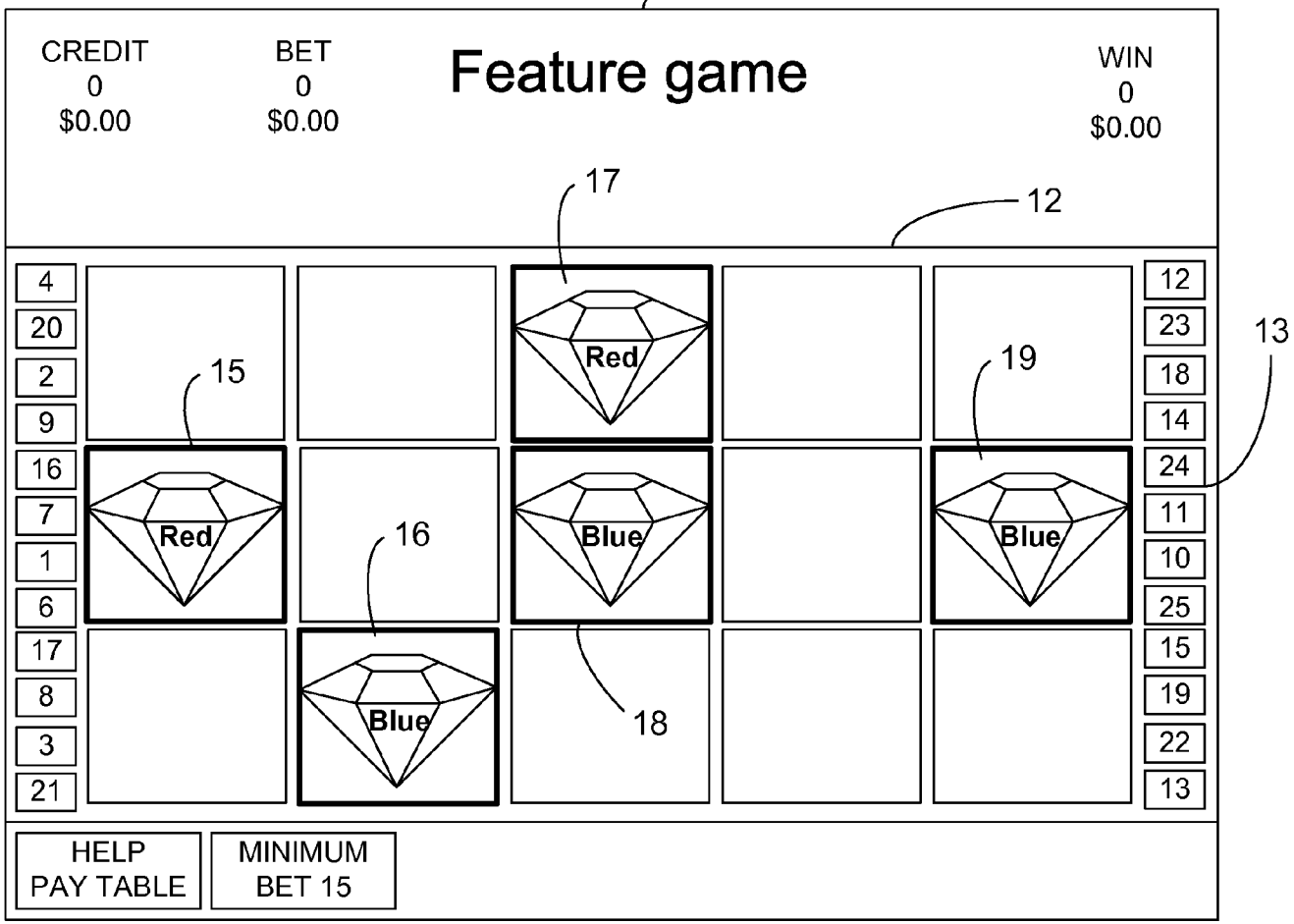
FIG. 12 is a diagram illustrating still another example of a game executed by the gaming machine pertaining to the present invention.

Next, another embodiment of the game, which is executed by the gaming machine pertaining to the present invention, will be described in reference to FIGS. 12-14. FIG. 12 illustrates another embodiment of the feature game for selecting the cells, to which a predetermined function is given in the secondary game. In this embodiment also, the cells 15-19 are the selected cells. In FIG. 12, however, red diamonds are displayed on the selected cells 15 and 17 while blue diamonds are displayed on the cells 16, 18, and 19. This means that the cells selected by the controller 30 are divided into two groups. In other words, the first group of selected cells (cells 15 and 17) are indicated with the red diamond symbol while the second group of selected symbols (cells 16, 18 and 19) are indicated with the blue diamond symbol. Thus, different groups of selected cells can be indicated by different indications.

Figure 13:
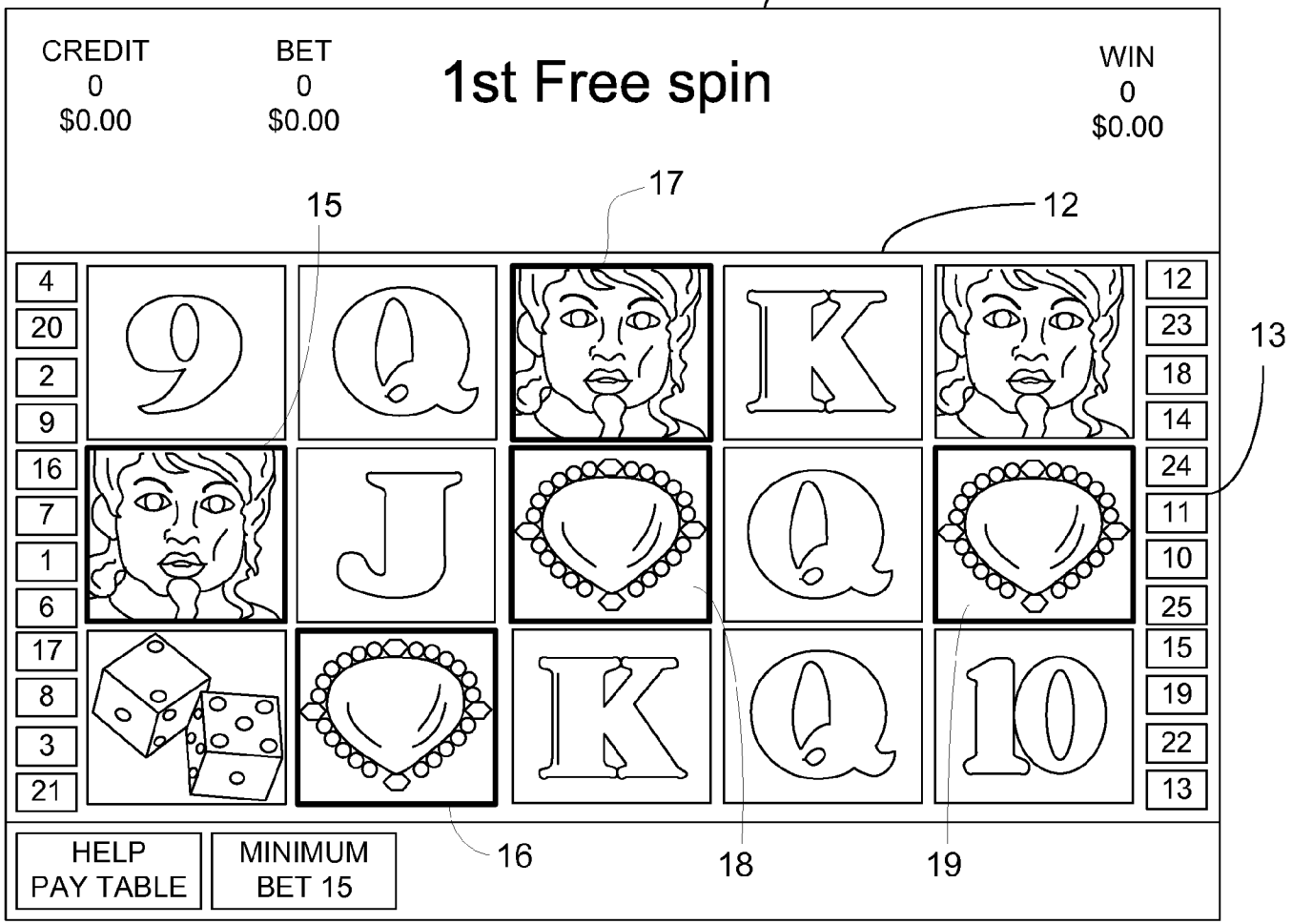
FIG. 13 is a diagram illustrating a state where a game situation shown in FIG. 12 has progressed further.

FIG. 13 is a diagram illustrating a state where a game situation shown in FIG. 12 has progressed further. FIG. 13 illustrates a state after the controller 30 has performed the first free slot game (or 1st Free spin) in the free spin game. As noted, different symbols are displayed on two groups of selected cells. Specifically, the wild symbols are displayed on the cells 15 and 17 belonging to the first group. The jewelry symbols are displayed on the cells 16, 18 and 19 belonging to the second group.

Figure 14:
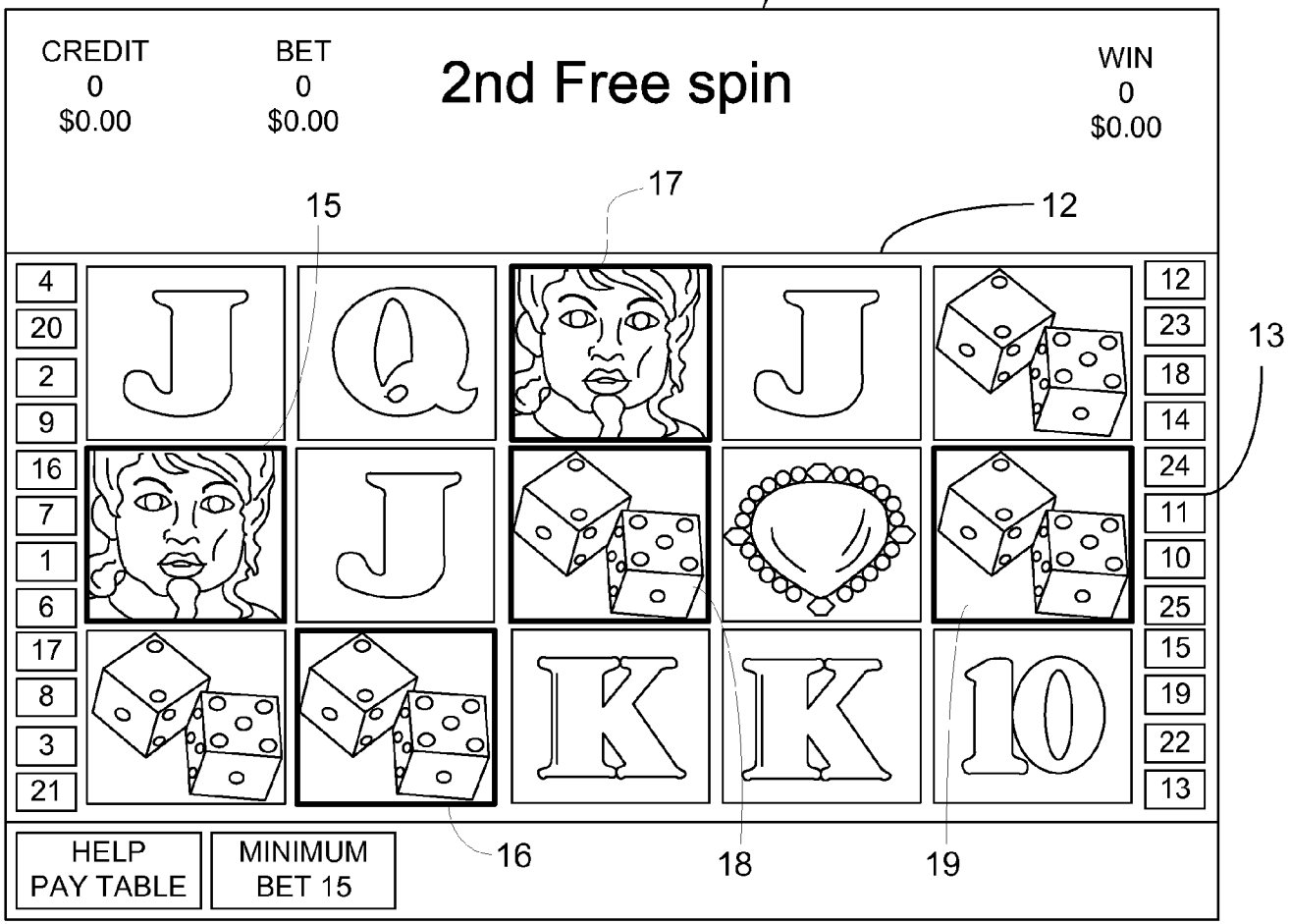
FIG. 14 is a diagram illustrating a state where a game situation shown in FIG. 13 has progressed further.

FIG. 14 is a diagram illustrating a state where a game situation shown in FIG. 13 has progressed further. FIG. 14 illustrates a state after the controller 30 has performed the second free slot game (or 2nd Free spin). The wild symbols are displayed on the cells 15 and 17. The dice symbols are displayed on the cells 16, 18 and 19. Thus, in each of the two groups of the selected cells, the same symbol is displayed. However, different symbols are displayed for different groups of selected cells. Thus, even in the case where the selected cells are divided into a plurality of groups, the symbols displayed in the cells belonging to the same group can be the same or related with each other so that the player can have an expectation of higher chance of winning combinations (and thus higher excitement) in the free game.

In this embodiment, when the controller 30 selects cells, the selected cells can be divided into two or more groups. The symbols shown in the cells belonging to the same group in the free spin game after the cell-selecting stage are preferably the same or related to each other. For example, when the selected cells are divided into the first group and the second, the wild symbols may be displayed on all of the selected cells of the first group, while high reward symbols may be displayed on all of the selected cells of the second group. It is also preferable for the controller 30 to change the number of the groups according to the number of the cells displayed on the display. For example, when there are relatively many cells, the controller 30 may set up more groups (for example, three or more groups).

Next, another embodiment of the game, which is executed by the gaming machine pertaining to the present invention, will be described in reference to FIGS. 15-17. Unlike the above-described examples, in this embodiment, the cells aligned in the vertical direction are integrated to form a column. In this embodiment, each column has a virtual reel therein such that three symbols on the reel are shown in the column at the same time when the reel is not spinning.

Figure 15:
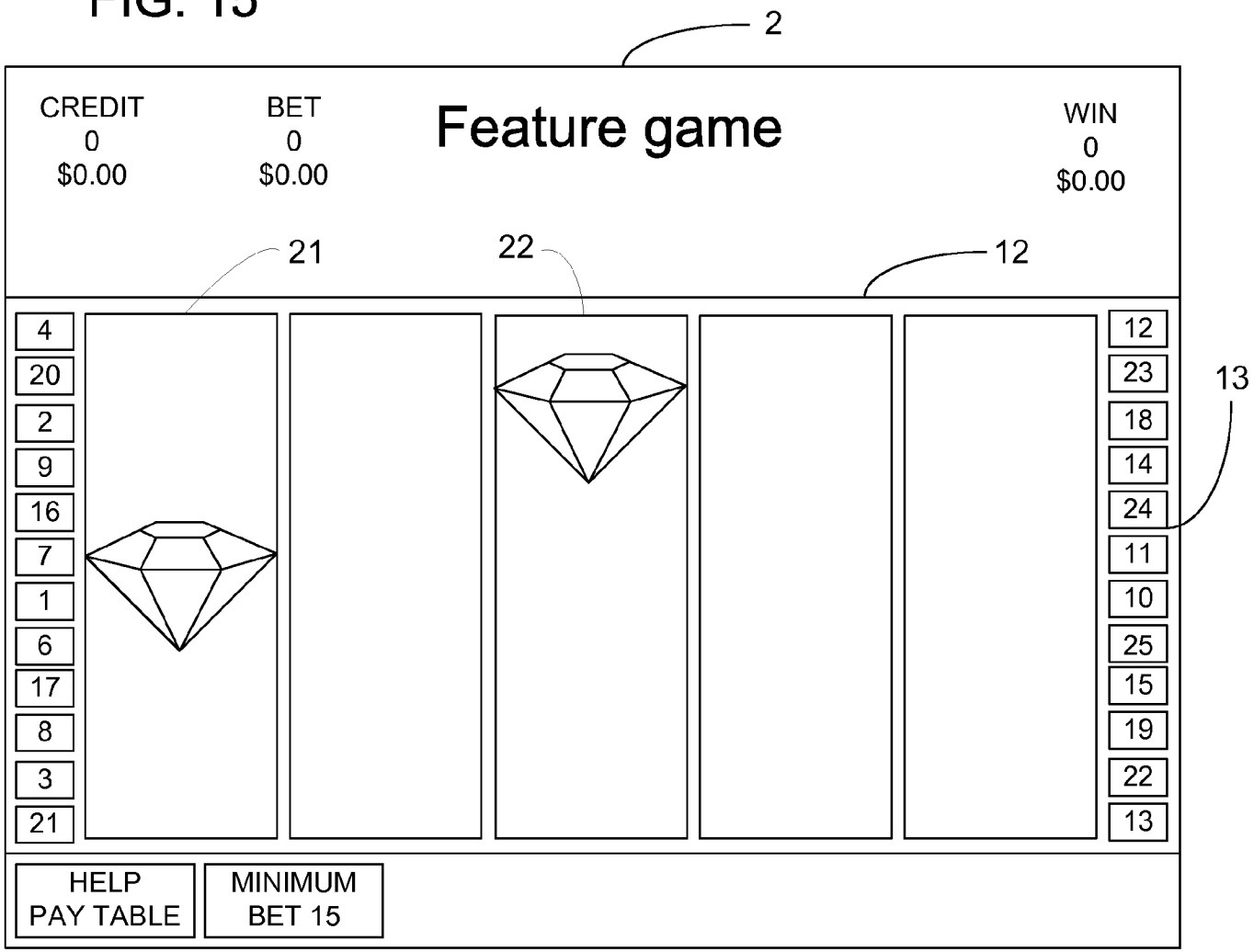
FIG. 15 is a diagram illustrating a further example of a game executed by the gaming machine pertaining to the present invention.

FIG. 15 illustrates a column selecting stage for selecting one or more columns to which a predetermined function is given in the secondary game. In the shown embodiment, the controller 30 has selected columns 21 and 22 and the diamond symbols are displayed on the columns 21 and 22 to indicate the selection.

Figure 16:
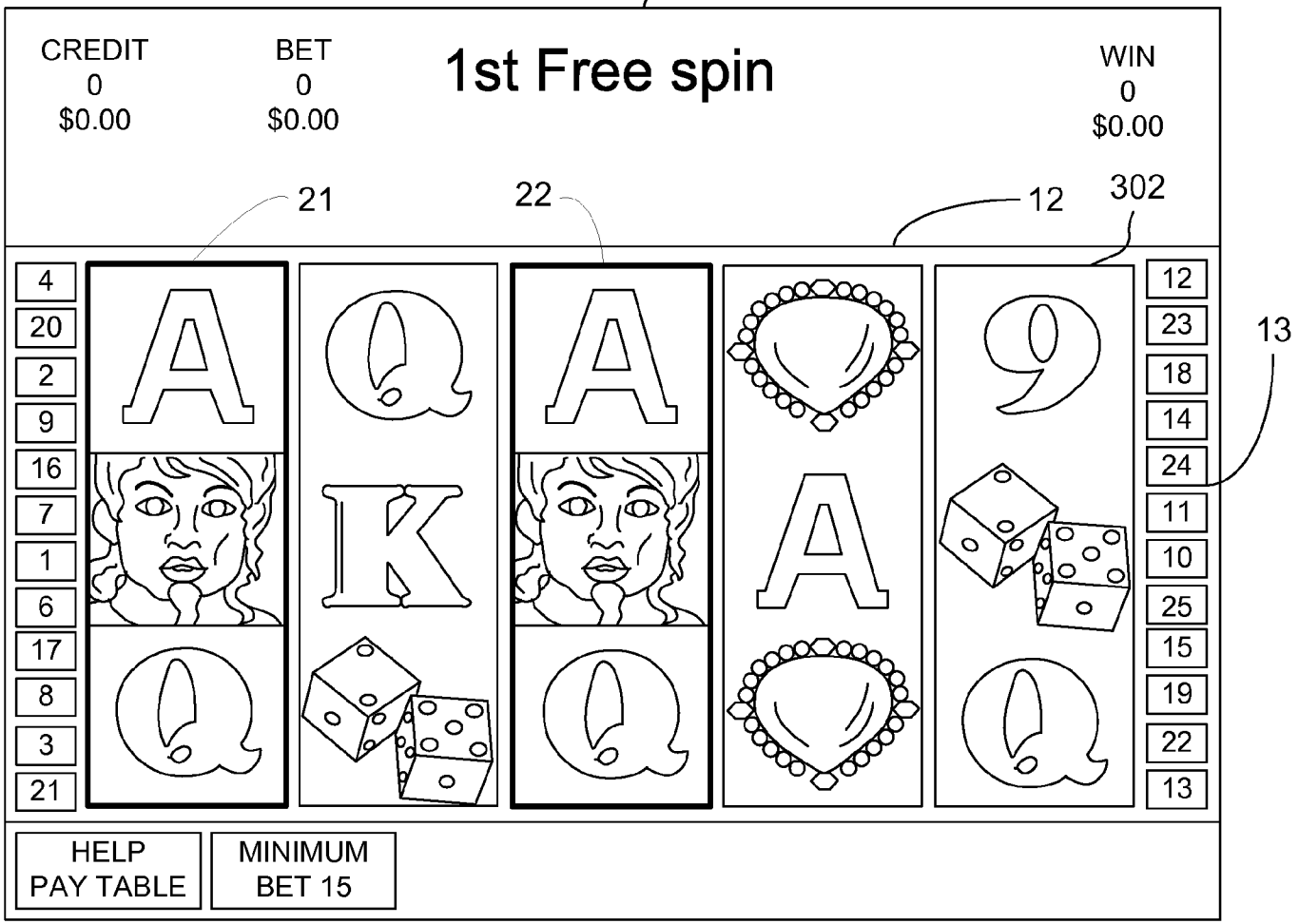
FIG. 16 is a diagram illustrating a state where a game situation shown in FIG. 15 has progressed further.

FIG. 16 is a diagram illustrating a state where the game situation shown in FIG. 15 has progressed further. FIG. 16 illustrates a state after the controller 30 has performed the first free slot game (1st Free spin). As shown on the selected columns 21 and 22, a plurality of symbols displayed on these columns is contrastingly arranged. In other words, the plurality of symbols on the selected columns 21 and 22 include the same symbols which are arranged in the same order. By this arrangement, it is possible to provide a sensation of a unity of the symbols on the reels to the player. This can make the player feel that a winning combination of symbols is likely to occur and thus encourage the player to continue to play the game.

Figure 17:
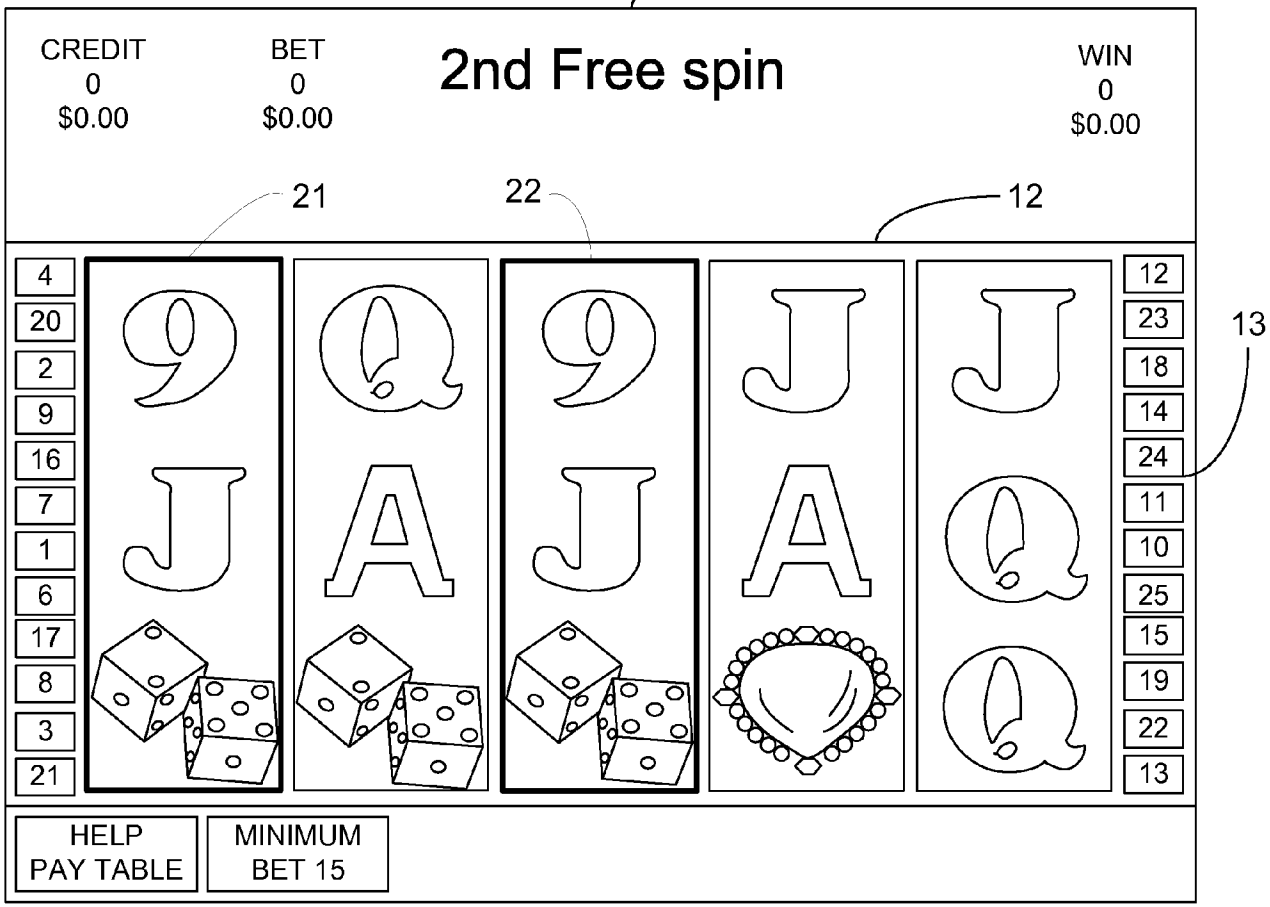
FIG. 17 is a diagram illustrating a state where a game situation shown in FIG. 16 has progressed further.

FIG. 17 is a diagram illustrating a state where the game situation shown in FIG. 16 has progressed further. FIG. 17 illustrates a state after the controller 30 has performed the second free slot game (2nd Free spin). In the example of FIG. 17 also, a plurality of symbols are contrastingly arranged on the selected columns 21 and 22. Thus, a plurality of symbols may be displayed contrastingly on the selected columns for every slot game of the free spin game. The symbols contrastingly displayed on the selected reels should not be particularly limited to specific symbols. The symbols and their order may be different for each spin. Alternatively, the same symbols may be displayed every time on the selected columns for different free spins. The symbols displayed on one selected column may not necessarily be different from each other. The symbols displayed on one selected column may include two or more same symbols or all symbols displayed on the column may be the same.

As an example of this embodiment, if all of the columns are selected in the column selecting stage, a plurality of the same symbols may be displayed in the same order on all columns (for example, the first column to the fifth column) in the secondary game. This will result in displaying the symbols providing a sensation of a unity to the player on all the columns on the display, which can increase the expectation of the player on a big win in the secondary game.

When the controller 30 selects two or more columns, a plurality of symbols shown on the display along the columns may be displayed so that the plurality of symbols are the same to each other and arranged in the same order. For example, as shown in FIG. 16, in the case where first and third columns are selected, when "A and a wild symbol and Q" are displayed on the first column, "A and a wild symbol and Q" may also be displayed on the third column. Of course, the number of symbols displayed along each column should not be limited to three and can be of any number. For example, the above-mentioned way for displaying the symbols in the selected columns can also be applied to a case where the controller 30 displays four or five symbols along the column. Further, in the above embodiment, the columns extend in the vertical direction such that when the reels rotate, the player will see the symbols on the reels move in the vertical direction. However, the columns may extend in a horizontal direction such that when the reels rotate, the player will see the symbols on the reels move in the horizontal or lateral direction. Such an arrangement is often referred to as a "horizontal reel" structure, and the present invention can be also applicable to such a structure to select a "horizontal" column(s).

On the other hand, the number of the columns (or reels) displayed on the display 12 may also be any number. However, when the number of entire reels is 5 for example, it is preferred that the controller 30 selects about ⅖-⅘ of the entire columns. It is more preferred that the controller 30 selects about ⅗ of the entire columns. If the number of columns is selected within ⅖-⅘ of the entire columns, these numbers are moderate when designing the secondary game, which excites the player. By the way, in the present invention, the column-selecting stage may also be referred to as "feature game".

In the above-mentioned cell- and column-selecting stage, the same or the related symbols can be displayed on all of the selected cells and columns. In the case where the cells and columns are shown in one screen, the controller 30 may select either a cell(s) or a column(s) or may select both of a cell(s) and a column(s). When both of the cell(s) and column(s) are to be selected, the cell selection and column selection may be performed at the same time or at different times. Furthermore, the cells or the columns that the controller 30 is able to select may be arranged in a horizontal direction and/or a diagonal direction.

In the game pertaining to the present invention, it is not necessarily required that only one symbol be displayed on one cell. Two or more symbols may be displayed on one cell. Also, it may be possible that a single symbol may be displayed across two or more cells. For example, a symbol extending from the upper end to the lower end of a certain column can be displayed across two or more cells. This extended symbol may not only extend vertically, but it may extend horizontally or diagonally.

Symbols displayed on cells or columns other than the selected cells or columns may be randomly displayed by using a random number. The symbols on the non-selected cells or columns may be the same as or different from the symbols displayed on the selected cells or columns.

After the cell-selecting stage or column-selecting stage, predetermined symbols, which may be the same or related to each other, are displayed in the selected cells or the selected columns when conducting the secondary game. Since the same symbols or the symbols related to each other in the selected cells or columns can generally appear to lead to a winning combination with a high probability, the player can have an expectation that winning combinations can easily be achieved and a big award can be obtained in the secondary game.

Figure 18:
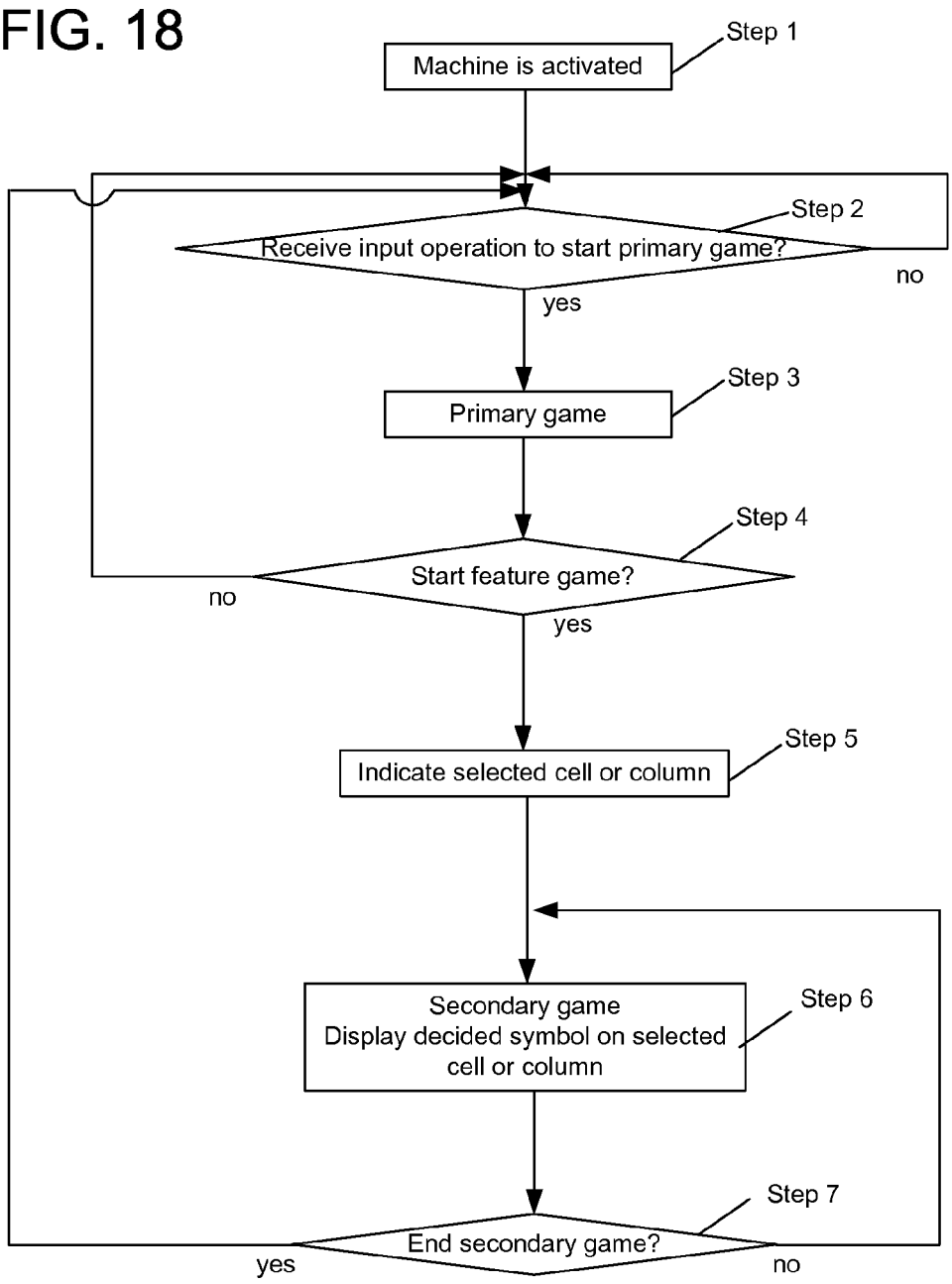
FIG. 18 is a flowchart illustrating an operation of a gaming machine pertaining to the present invention to perform a game.

Next, an operation of the gaming machine pertaining to the present invention to execute the above-mentioned game will be described. FIG. 18 is a flowchart illustrating an example of the operation that the gaming machine of the present invention performs. FIG. 18 indicates an essential operation of the present invention. First, the gaming machine is activated when the gaming machine is powered on (step 1). The controller 30 equipped in the gaming machine waits for an input operation from a player to start the primary game (step 2). When the controller 30 receives the input operation, the controller 30 starts and executes the primary game (step 3). If the controller 30 does not receive the input operation from the player, it keeps waiting for the input operation.

The controller 30 starts the cell or column-selecting stage (the cell or column-selecting stage is also referred to as feature game.) if the controller 30 recognizes that a predetermined condition is satisfied (step 4) in the primary game. If the controller 30 recognizes that a predetermined condition is not satisfied, the process goes back to step 2 and the controller 30 waits for the input operation from the player to start the primary game. If it is found that the predetermined condition is satisfied in step 4, the process proceeds to step 5 in which the controller 30 indicates a selected cell or column on the display in the feature game (step 5). Usually, selecting the cell or column is executed by the controller 30 when the controller 30 receives the input operation from the player. However, this selecting may be executed any time by the controller 30.

The controller 30 starts the secondary game after indicating the selected cell or column. The controller 30 indicates a decided symbol on the selected cell or column in the secondary game (step 6). Usually, selection of the symbol to be indicated on the selected cell or column is executed by the controller 30 when the controller 30 receives the input operation from the player. However, this selection may be executed any time by the controller 30. After the secondary game, the controller 30 determines if the secondary game is finished (step 7). If the controller 30 determines that the secondary game is finished, the controller 30 waits for the input operation from the player to start the primary game (step 2). If the controller 30 decides that the secondary game is not finished yet, the controller 30 starts the secondary game again (step 6).

Figure 19:
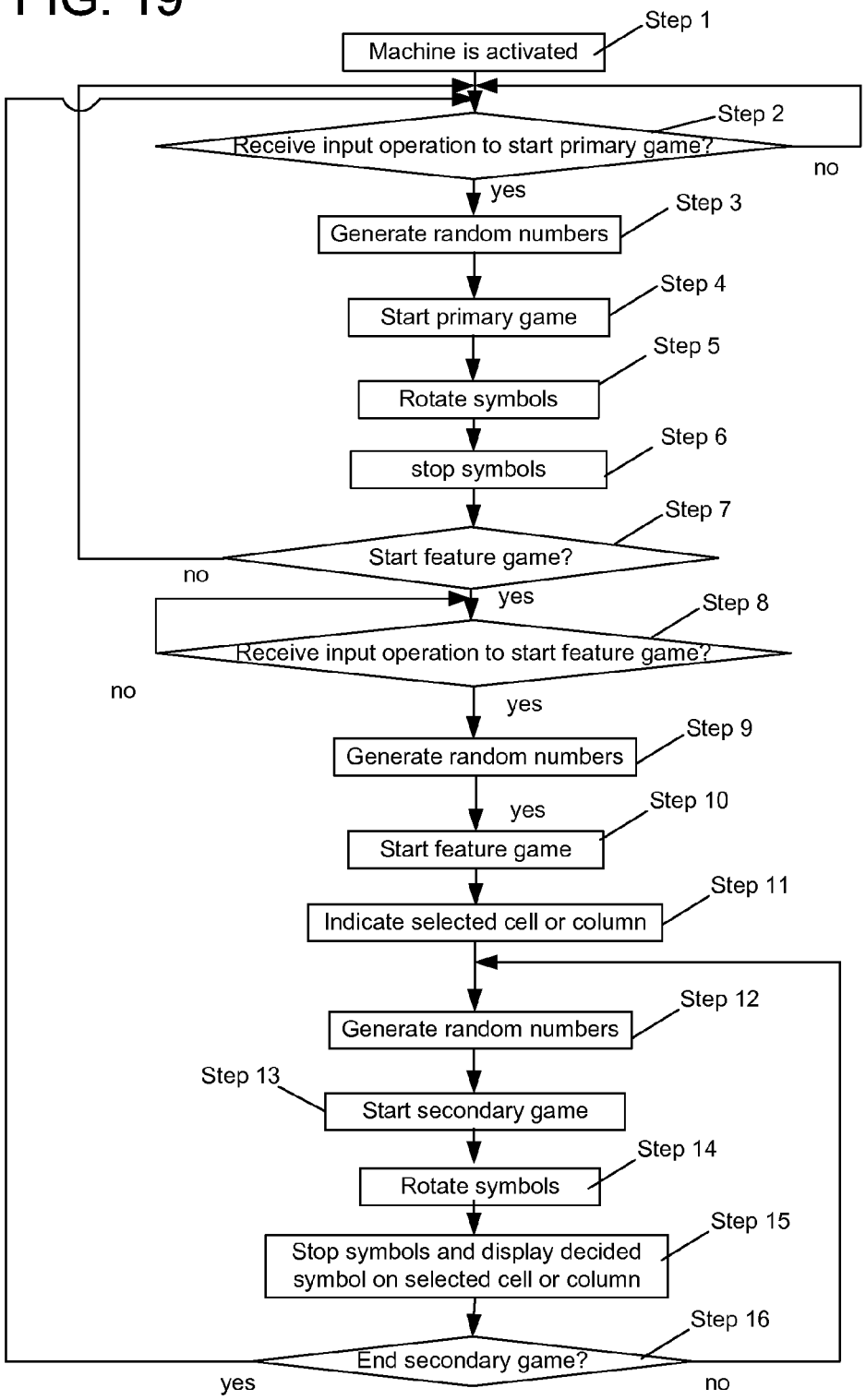
FIG. 19 is a flowchart illustrating an example of the operation that the gaming machine of the present invention performs.

Next, FIG. 19 will be explained. FIG. 19 is a flowchart illustrating another example of the operation that the gaming machine of the present invention performs. First, the gaming machine is activated when the gaming machine is powered on (step 1). The controller 30 equipped in the gaming machine waits for the input operation from the player to start the primary game (step 2). When the controller 30 receives the input operation, the controller 30 decides results of the primary game by generating a random number (step 3) and starts the primary game on the display (step 4). In the primary game, the controller 30 rotates the reels for a while and then stops the rotation of the reels to show the symbols according to the decided game results (steps 5 and 6). The controller 30 pays out the award if the winning symbol combination is arranged on the activated pay line. If the controller 30 does not receive the input operation from the player, it keeps waiting for the input operation (step 2).

After that, the controller 30 starts the cell-selecting stage or column-selecting stage (the cell-selecting stage or column-selecting stage is also referred to as a feature game.) if the controller 30 determines that a predetermined condition is satisfied by generating the random number (step 7). If the controller 30 determines that the predetermined condition is not satisfied, the controller 30 waits for the input operation from the player to start the primary game again (step 2). If it is found that the predetermined condition is met in step 7, the process goes to step 8 where the controller 30 waits for an input operation from the player to start the feature game (step 8). When the controller 30 receives the input operation, the controller 30 conducts the cell-selection or column-selection by generating a random number (step 9) and then starts the feature game on the display (step 10). The controller 30 indicates a selected cell or column on the display in the feature game (step 11) by highlighting the selected cell or selected column to be recognized from the player, for example. If the controller 30 does not receive the input operation from the player, it keeps waiting for the input operation to start the feature game (step 8).

Then, the controller 30 generates random numbers to decide results of the secondary game and symbols to indicate on the selected cell or column (step 12). After generating the random numbers, the controller 30 starts the secondary game (step 13). The controller 30 rotates the reel for a while and then stops the reels (steps 14 and 15) to show the symbols decided with the random numbers including those on the selected cell or column (step 15). After calculating the prizes to be paid out to the player based on the shown symbols, the controller 30 determines if the secondary game is finished (step 16) or not. If the controller 30 determines that the secondary game is finished, the process goes to step 2 where the controller 30 waits for the input operation from the player to start the primary game. If the controller 30 determines that the secondary game is not finished yet, the controller 30 starts the secondary game again (step 12).

Figure 20:
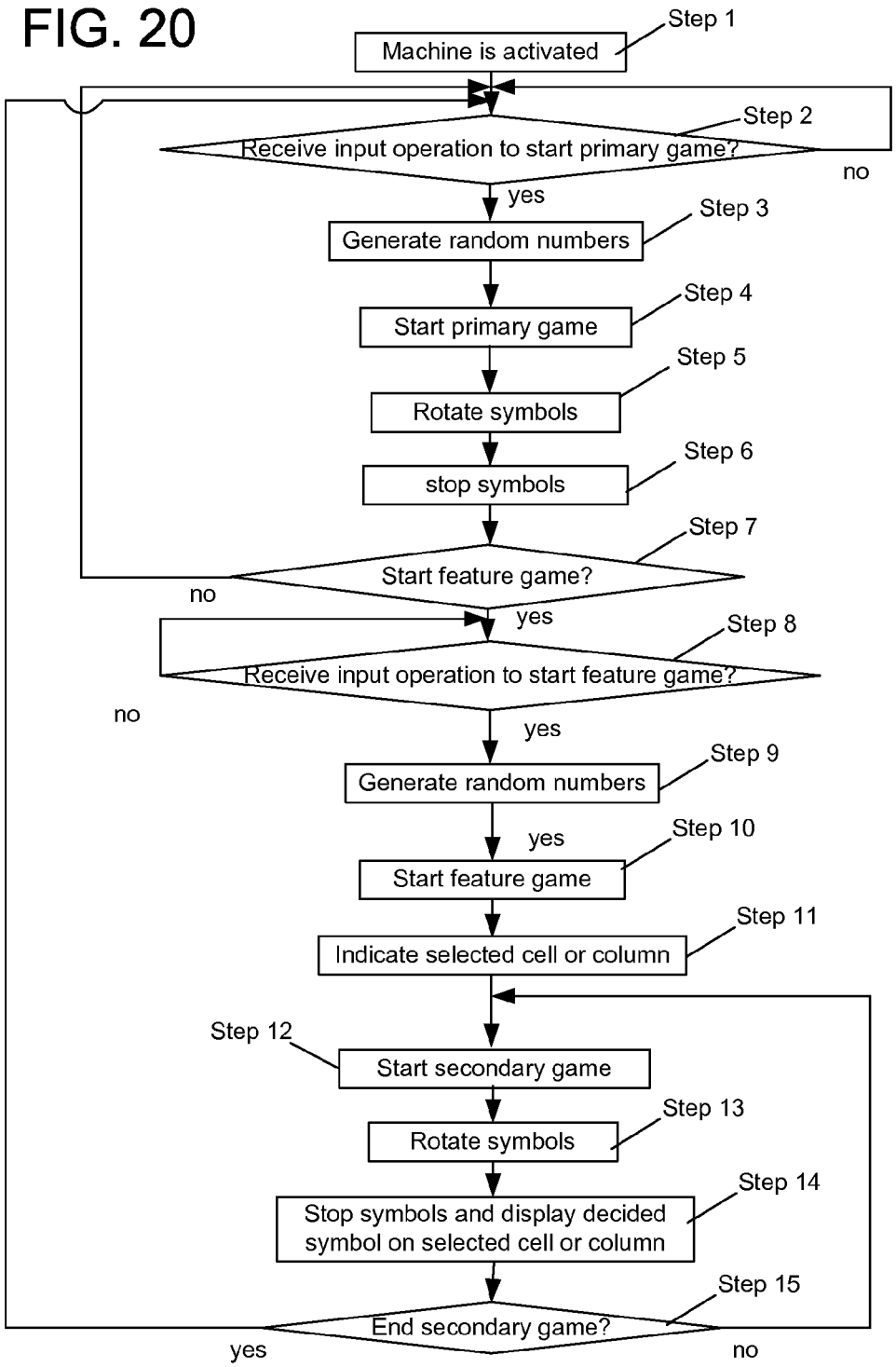
FIG. 20 is a flowchart illustrating another example of the operation that the gaming machine of the present invention performs.

Next, FIG. 20 will be explained. FIG. 20 is a flowchart illustrating another example of the operation that the gaming machine of the present invention performs. The operation of FIG. 20 is similar to FIG. 19, but FIG. 20 is different from FIG. 19 in terms of not having the step to generate a random number before starting the secondary game (i.e., step 12 in FIG. 19). Namely, in the embodiment of FIG. 20, the random numbers generated in step 9 are used not only in selecting the cell or column but also in deciding the results of the secondary game including what symbols should be shown in the selected cells or columns. After that, the controller 30 executes the feature game and then executes the secondary game without the step of generating the random number corresponding to step 12 of FIG. 19.

Figure 21:
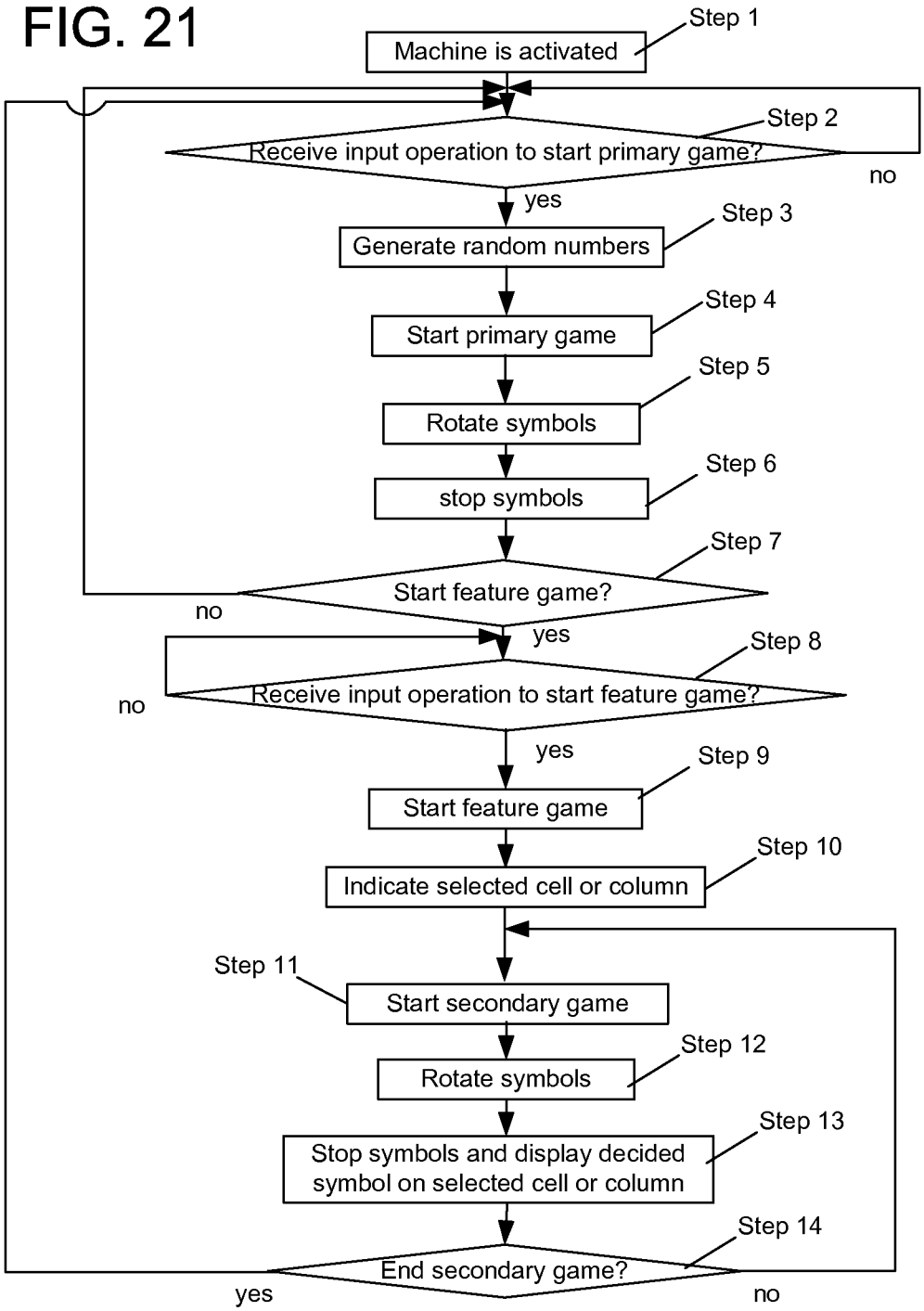
FIG. 21 is a flowchart illustrating another example of the operation that the gaming machine of the present invention performs.

Next, FIG. 21 will be explained. FIG. 21 is a flowchart illustrating another example of the operation of the gaming machine of the present invention. The operation of the gaming machine in FIG. 21 is similar to the operation of gaming machine in FIG. 19, but FIG. 21 is different from FIG. 19 in terms of not having the steps (steps 9 and 12 of FIG. 19) to generate the random number before starting the feature game and starting the secondary game. In other words, the controller 30 decides the results of the primary game and the secondary game and selects the cell or column indicated in the feature game based on the random numbers generated in step 3. Therefore, the operation of FIG. 21 does not have the steps corresponding to the steps 9 and 12 of FIG. 19.

FIGS. 19, 20 and 21 are to explain the timing when to generate the random numbers to decide game results including the primary game, the feature game and secondary game. However, the timing to generate the random numbers is not limited to the flowcharts illustrated in FIGS. 19, 20 and 21 and the timing to generate the random number may be any appropriate time. For example, the timing for generating random numbers used in the cell or column selection may be after the controller 30 stops the rotation of the reels on the display to show the results of the primary game, i.e., between steps 6 and 7 in FIG. 19.

Figure 22:
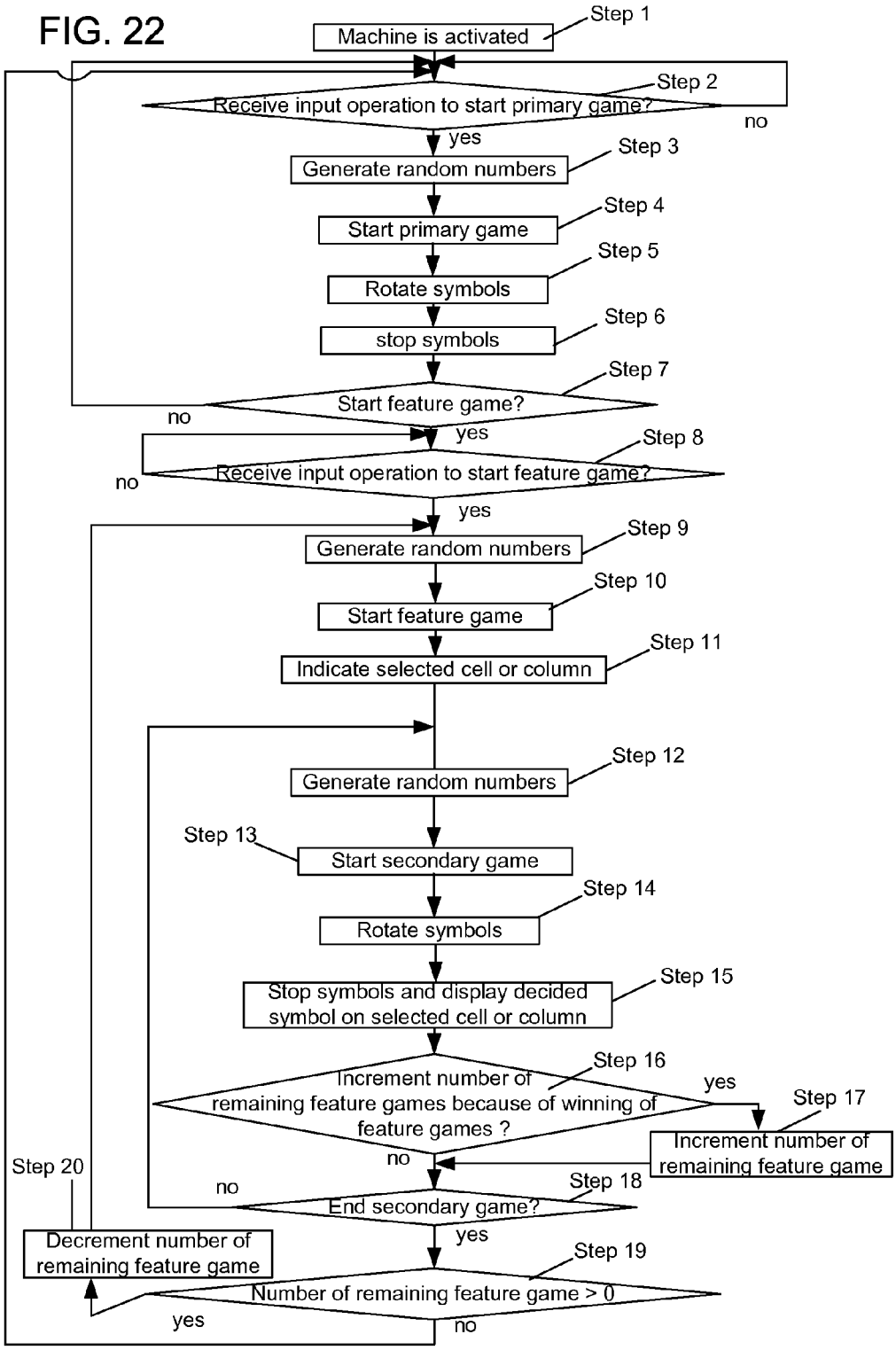
FIG. 22 is a flowchart illustrating another example of the operation that the gaming machine of the present invention performs.

Next, FIG. 22 will be explained. FIG. 22 is a flowchart illustrating another example of the operation that the gaming machine of the present invention performs. FIG. 22 explains the case that the player wins the feature game (or additional secondary game) in the secondary game. In FIG. 22, the steps 1 to 15 are the same as the steps 1 to 15 of FIG. 19. In FIG. 22, the controller 30 decides whether the predetermined condition is satisfied or not to increment the number of remaining feature game (step 16). If the predetermined condition is satisfied, the controller 30 increments the number of remaining feature game (step 17). If the predetermined condition is not satisfied (step 16) or the controller 30 increments the number of feature game (step 17), the controller 30 determines whether the secondary game has been finished or not (step 18). If the controller 30 decides that the secondary game has not been finished, the controller 30 keeps executing the secondary game (step 12). If the controller 30 decides that the secondary game has been finished, the controller 30 determines whether the number of remaining feature game is more than 0 (step 19). If the number of remaining feature game is more than 0, the controller 30 executes the feature game again after decrementing the number of remaining feature game (step 20 and steps 9-11). If the number of remaining feature game is 0 in step 19, the controller 30 waits for the input operation from the player to start the primary game (step 2). After executing the new feature game in steps 9-11, the controller 30 conducts the "additional" secondary game (steps 12-18). The operation of the gaming machine is not limited to the operation shown by the above-mentioned flow chart. For example, in the flowcharts of FIGS. 19-22, the feature game (cell-selection or column selection) is conducted only once before executing the secondary game. However, as mentioned above, it is possible to conduct the feature game a plurality of times in the secondary game such as when the feature game is provided between every adjacent reel spins of the free spin game executed as the secondary game.

Figure 23:
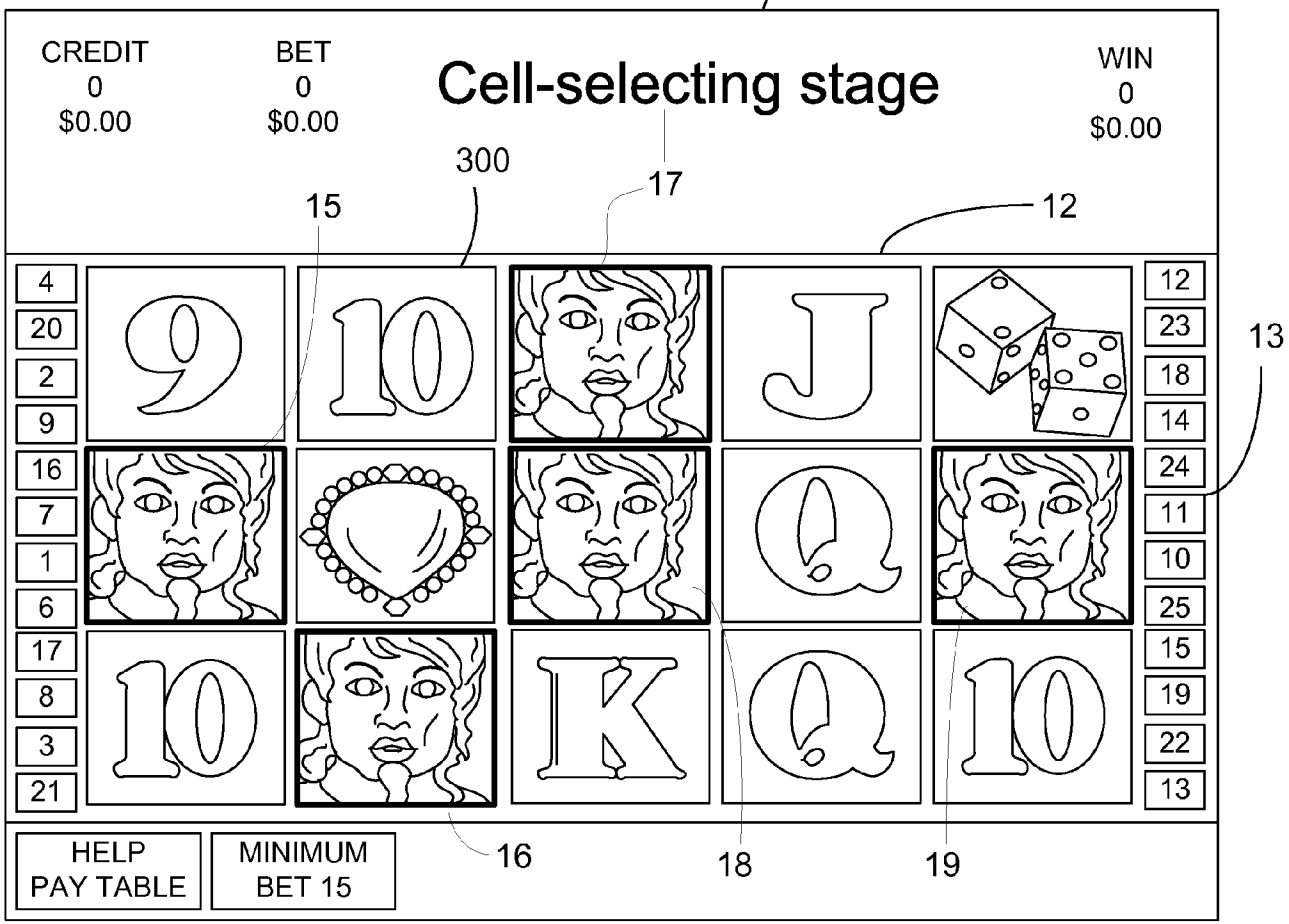
FIG. 23 is a diagram illustrating an example at the start of the cell-selecting stage of the present disclosure.

FIG. 23 illustrates the cell-selecting stage. In FIG. 23, the beginning of the cell-selecting stage is shown. Five cells are indicated as selected. In this example, this is noted by the bold border along the periphery of each selected cell in distinction from the non-selected cells which do not have bold borders along the periphery. However, the means of distinguishing is not limited to this feature but may rather be indicated by color of the cell, color of the symbol in the cell, shape of the symbol in the cell, selection of the symbol in the cell, or any other common means for distinguishing symbols or cells from one another. Furthermore, in this figure, all of the symbols in the selected cells are the same face. If, for example, this followed the primary game, then this could represent the final result of the cell-selecting stage.

FIG. 24 is a flowchart illustrating an example of the selected cells being moved on the display from their position as shown in FIG. 23. In this case, the cell marked as 17 did not move. However, cells marked 15, 16, 18, and 19 moved to new locations. The total number of selected cells did not change. Selected cell 15 and the cell indicated by 300 swapped places on the display. Cells 16, 18 and 19 each swapped placed as well. This movement can be instantaneous or it may occur slowly enough for the player at the gaming machine to see the movement. The movement may continue until each cell comes to their resting place on the display. Furthermore, it may be that all of the selected cells move to new locations on the display. It may also be that for example that selected cell labeled 16 moves to the position inhabited by selected cell labeled 19. This won't be apparent if all of the selected cells contain the same symbol, but it may be apparent if the selected cells do not contain the same symbol. This may be noted in the situation where there are two groups of selected cells, a first group (the at least one selected cell in a first group) and a second group (the at least one selected cell in a second group); if the first group of selected cells displays one symbol and the second group of selected cells displays a different symbol, then the movement of a cell in the first group and a cell in the second group will be apparent on the display.

Figure 25:
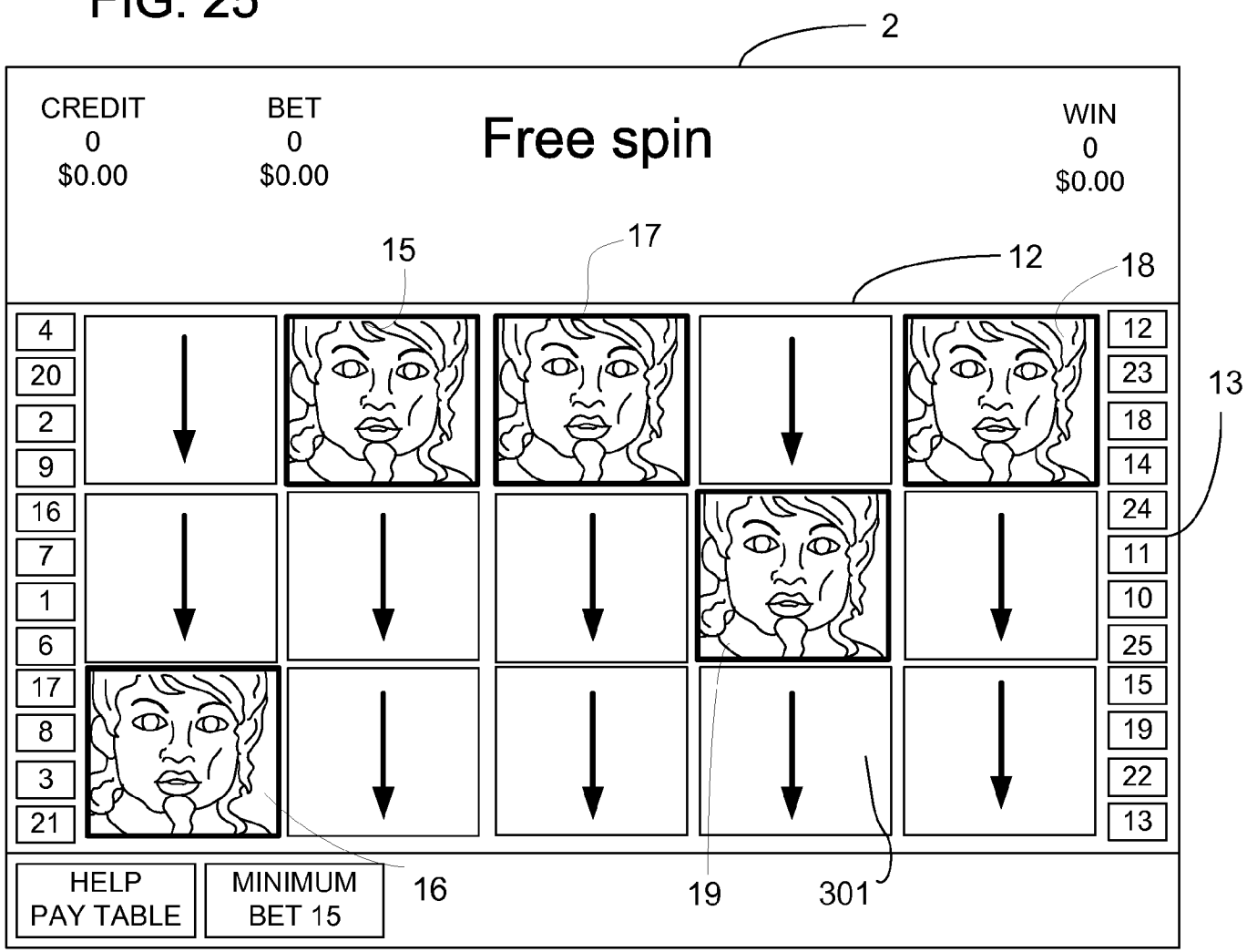
FIG. 25 is a diagram illustrating an example of a free spin game following FIG. 24.
Figure 26:
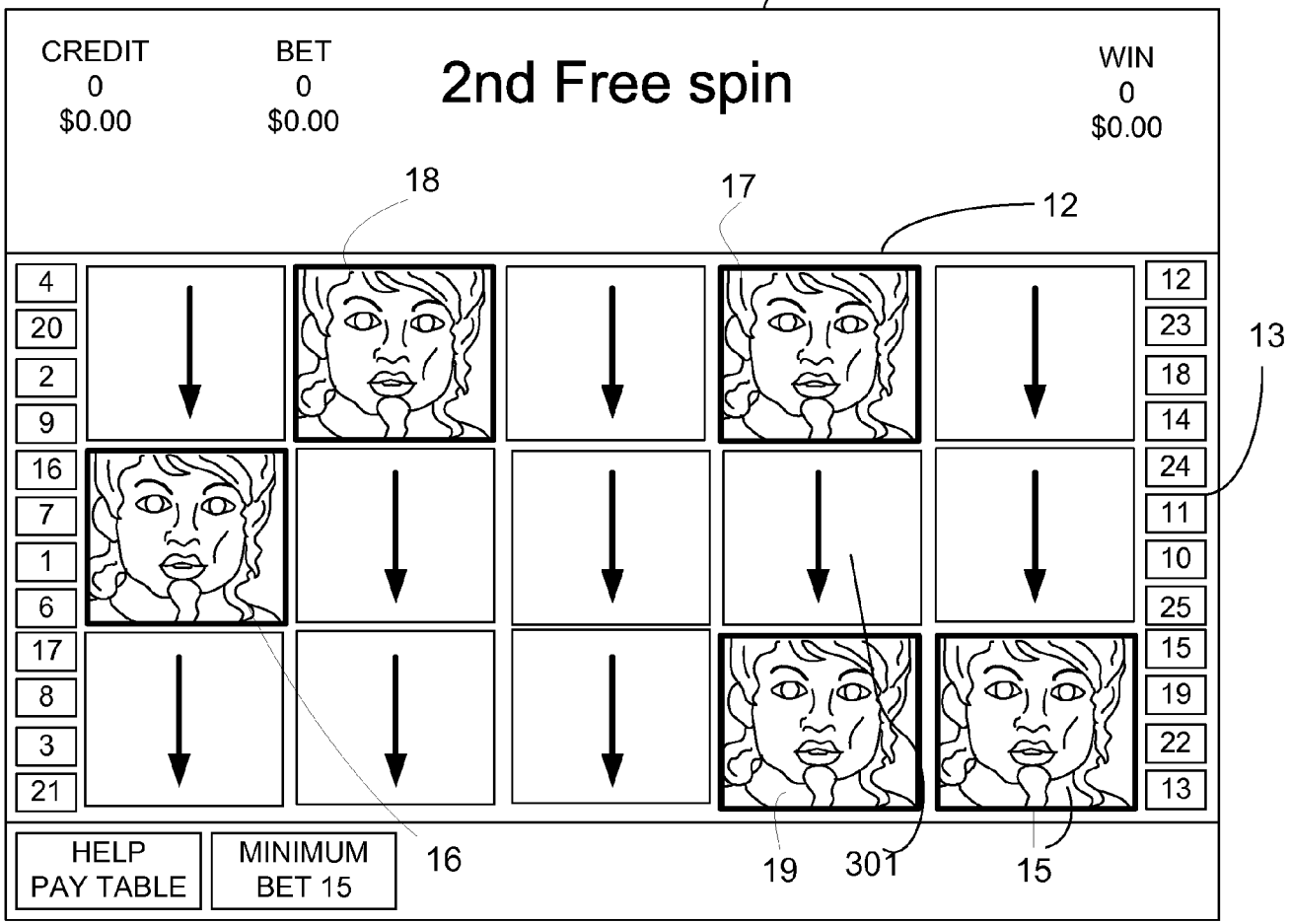
FIG. 26 is a diagram illustrating movement of the selected cells during a free spin game shown in FIG. 25.

FIG. 25 represents the start of a free spin game where the non-selected cells are indicated as spinning. This may be the first free spin game or the second free spin game or any free spin game that is part of the secondary game. No result symbol is presented in the non-selected cells as this free spin game has not concluded. The selected cells are in the place indicated by FIG. 24 but have moved from an earlier location on display as seen in FIG. 23 for this free spin of the same secondary game. The free spin game may continue with the selected cells remaining in their fixed cells until the conclusion of the free spin game where the result symbols are displayed on the screen. It may also be that the free spin game doesn't conclude before the selected cells migrate as seen in FIG. 26. Thus, while the number of selected cells is fixed for this secondary game, the position of the cells can be fluid on the display prior to the start of a free spin game or during a free spin game and the positions of the selected cells aren't required to be in a fixed location until the free spin game results are to be determined or that free spin game of the secondary game is otherwise concluded. If FIG. 25 represents the second free spin game for example, the first free spin game of that secondary game may be represented by FIG. 8. FIG. 8 shows the five selected cells in cells labeled 15-19. The selected cells move as shown in this example to positions indicated by FIG. 24. FIG. 25 then shows the position of the five selected cells for the second free spin game.

FIG. 26 represents another variation of the movement of the selected cells that is possible in this disclosure. The non-selected cells continue to spin in this example. However, the selected cells continue to move before the conclusion of the free spin game. For example, Cell 19 and Cell 301 swapped places on the display. Cell 19 moved down one cell position from FIG. 25 to FIG. 26. Each of the other selected cells similarly moves. The second free spin game may then conclude or the selected cells can continue to move until the free spin game concludes.

Figure 27:
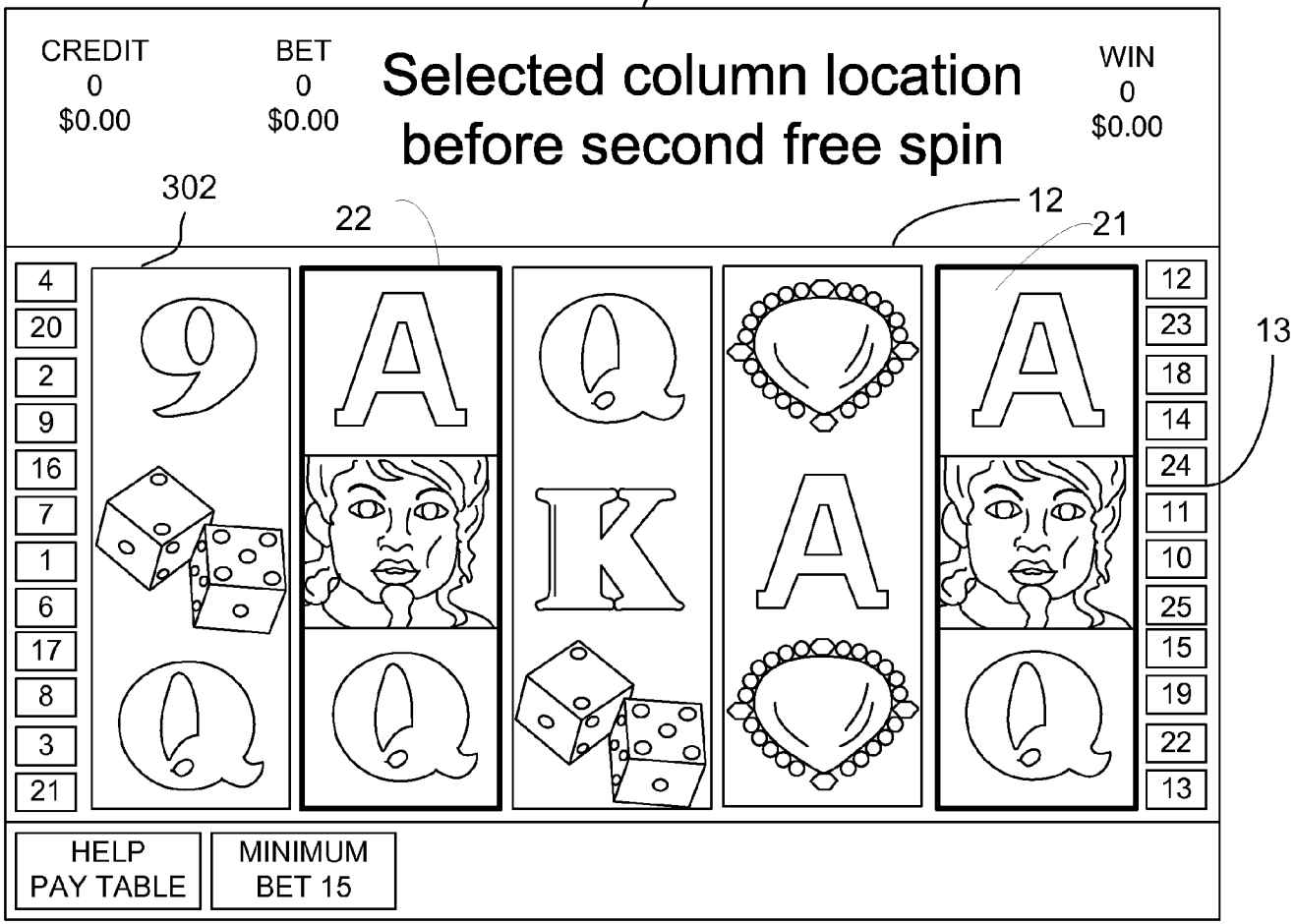
FIG. 27 is a diagram illustrating movement of the selected columns in a column-selecting stage after the free spin game shown in FIG. 16.

When looking at the version with columns having several cells in a column, the column-selecting stage occurs similarly to the cell-selecting stage in the current disclosure. The columns in this version are selected in contrast to the cells which may hold, contain or show individual symbols. The columns by nature represent a plurality of cells where a plurality of symbols can be indicated. In the column selecting version, all of the cells in any one selected column do not need to be equivalent. This is shown in FIG. 27. It may be though that all the symbols are the same in any one selected column. It may also be that if more than one selected column has been specified by the controller, that each selected column is identical except for position on the display. In this example, the columns are shown in their location prior to the second free spin game. If column 16 represents the column-selection for the first free spin game, then FIG. 27 may indicate one of many variations for the location of the selected columns prior to a second free spin of the secondary game. In this case, the column labeled 21 is moved to location labeled 302 from FIG. 16 to FIG. 27. The two columns in this case swapped places. Column 21 is then at the far right position and column 302 is at the far left position in this example. However, the number of selected columns remained constant. While not shown in diagrams, several variations of movement of the columns are possible. Any selected column can move to any other column on the display. In principle, even two selected columns could swap places with one another although if that did happen and the columns had identical content, then that movement might not be apparent on the display. As with the individual cells selected, the column movement may occur before during or after the result symbols for each cell and column are shown. It may be that the selected columns are changing location on the display while the non-selected columns are spinning or are flipping or are blank or are with hidden content.

Once cells are selected, the symbols are set by the controller for the selected cells. The selected cells can then remain in their current place for a free spin game where the non-selected cells spin and the selected cells continue to show their specified symbols. The results of the free spin game can then be determined by the gaming machine. It may also be that the selected cells while being constant may exchange their content with other selected cells if the selected cell content varies between selected cells. The cells are means of communicating with the player the symbols used in the game and the position of the cells are relevant to the outcome of the game. Cells are displayed in such a manner that a player can see the cells or the symbols in the cells on the display.

If the positions of the cells are indicated by fixed cell locations on the screen and if the selected cells are moved to another location on the screen with the cells, then the content of the selected cell will be the same as it was before but in a new position and the non-selected cell which was displaced from its current position will migrate to the previous cell location of the selected cell as was discussed for the figures. The spin of the second free spin game can be conducted, for example, by pressing a button or pulling a level on the gaming machine. The contents of the non-selected cell will then be spun as in the primary game but the content of the selected cells will remain constant.

For example, one reel strip has a sequence of twenty symbols; some of those symbols may be blank; the sequence may be represented as going from symbol 1 to symbol 20; as the reel is spinning in the cell, the symbols being shown while spinning may be going from symbol 1 to symbol 20 in order and back to 1 repeating the cycle until it comes to the result symbol (for example, stopping at symbol 15). Reels may have any specified number of symbols or stops as desired whether they are virtual reels or physical reels. Another reel may have 50 symbols. Each reel can represent a distinct sequence of symbols. The reels need not be spun from 1 to 20 in a cycle until a result is determined. It may be useful to have some reels spin from 1 to 20 in a cycle while others spin in reverse order, for example, 20 to 1 in a cycle. It may also be desired to have some reels spinning down from the observer in front of the gaming machine and have other reels spinning up from the observer in front of the gaming machine.

The plurality of cells may be shown in rows and columns. This is particularly useful in reel games such as slot machines. The cells can be stacked vertically in columns. Columns can be stacked to either side of other columns so that rows of cells are shown as well. These cells can be adjacent to each other. Cells need not be square but can be rectangular or other shapes as well. Rectangular shapes are particularly suitable for displaying several symbols in a column or a row. This is seen for example in slot game.

The selected cells may be set to the same symbol or a series of random symbols or filled with wild symbols. The inventor is not indicating that these are the only symbols or symbol patterns to be shown in the selected cells. The secondary game may then be a free spin game where the cells other than the selected cells are spun or otherwise have the symbols change. When the spin starts, the symbols in the free spin game begin to change. They continue changing until they come to their resting position or result position revealing a result symbol or resting symbol.

It may be that the symbols of the first group of selected cells and the symbols of the second group of selected cells remain the same between different free spin games or different reel spins of the round of free spin games that constitutes the secondary game or free spin game being claimed. It may also be that those symbols themselves are shuffled, or changed. For example, the symbols in the first group may be wild symbols and the symbols in the second group may be an ace in the first free spin game and remain that way in the second free spin game or a second reel spin of the free spin game. In another example, the symbols in the first groups may be wild symbols and the symbols in the second group may be an ace in the first free spin game and then the symbols are changed to be queens in the first group and wild symbols in the second group in the second free spin game.

The cell-selecting stage between the primary game and the secondary game can be configured to operate in several fashions. For example, once the game machine has indicated a secondary game is to be played on the gaming machine, the gaming machine can enter the cell-selecting stage. Since this cell-selecting stage is after the primary game, the display may still indicate the results of the primary game on the screen while the controller determines the number of cells to be selected or while the controller is in the process of selecting the cells to be selected. Furthermore, besides displaying the results of the prior game at the start of the cell-selecting stage, for examples, the results of the primary game or the prior free spin game, the gaming machine may empty the cells of content showing blank cells and remain blank during the cell-selecting stage. It might be that the border is changed temporarily for display on the display to indicate the process of selecting the cells to be selected. It might also be the case that instead of showing a border, the tone or color of the cells may be temporarily changed to indicate the process of selection.

Additionally, the cells may be filled with random symbols chosen from the available symbols. Additionally again, the cells may be filled with the same symbol or any variety between randomly filled and equivalently filled cells. Additionally again, the cells may be filled with a solid color such as blue or red or they may be filled with varying colors from one cell to the other or cells can be individually filled with a mixture of colors. Yet again, the selected cells may be made to change shape which may be easily implemented on a gaming machine using a video display screen. A wide variety of patterning is available for the visual display of the cells at the start of the cell-selecting stage and throughout the cell-selecting stage and these represent only a few of the possible varieties available for display in the cell-selecting stage.

Once this stage has been initiated, the individual selected cells may be made to move from one position to another where the contents of the selected cell are moved to another cell on the display and the contents of that other cell are swapped with the contents of the selected cell. Alternatively, the cell-selection may take place by indicating one cell and then another but leaving the content of the individual cells the same as they were before changing selection.

The number of cells to be selected may vary from the start of the cell-selecting stage to the end of the cell-selecting stage. However, at the end of the cell-selecting stage, the number of selected cells remains the same throughout the immediately subsequent secondary game play, that is, the number of selected cells remains the same throughout each of the free spin games or reels spins of that secondary game. There may be one secondary game to follow a primary game or there may be more than one free spin game that follows the secondary game. For example, three free spin games may each be games in the secondary game; the secondary game being the one triggered by the primary game. Regardless or the number of free spin games or reel spins associated with the secondary game that follows the primary game, the number of selected cells remains constant once selected before starting the secondary game.

The gaming device or gaming machine may be configured to choose the number of cells to be selected at the start of the cell-selecting stage or it may be configured to fix the number of selected cells after the start of the cell-selecting stage but before the start of the secondary game that follows the primary game. For example, at the start of the cell-selecting stage, the number of cells selected may be indicated to be two at the start of the cell-selecting stage where two of the plurality of available cells are highlighted with a border then where five cells are selected as highlighted with, for example, a border (the previous two no longer being highlighted unless one or both were now part of the five that are indicated to be selected) then where three cells are selected (the previous five no longer being highlighted unless one or more of the five is part of the three that are now indicated to be selected). If three was then fixed, or chosen for that round of secondary games to be played on the gaming machine, then the number of cells selected would remain three throughout that session of secondary game play regardless of the number of free spin games or reel spins for that secondary game.

Once the secondary game play has ended and the gaming machine enters the primary game or feature game again, the number of cells will again be chosen when the next secondary game is activated. For example, if three cells were selected and fixed in the secondary game discussed above and a new primary game was subsequently played on the gaming machine which then triggered a new secondary game, the secondary game that follows this primary game would not necessarily be fixed at three cells. The cell-selecting stage would start as discussed for the previous case and then fixed prior to the play of the next round of secondary games. For example, the number of selected cells may be fixed at two of the available cells in the cell-selecting stage in the next round of secondary games. Another example is that the number of selected cells may be fixed at 5 in that cell-selecting stage for that round of secondary games.

The position of the cells once selected in the cell-selecting stage may be moved prior to the start of the secondary game, during the secondary game, between each of the secondary games that is associated with the primary game which triggered the secondary game, or in a shuffling fashion. These positions may even move after the gaming machine has initiated the spin of the non-selected cells if the game is configured to be a slot machine for example. Thus, the symbols of the non-selected cells may be changing and not fixed, while the selected cells are changing place from one of the cells on the display to another of the cells on the display. The contents of the cells can be swapped so that the selected cell which migrated to a different cell on the display can retain its content where the previous contents of the other cell which is now occupied by the selected cell are placed in the cell which was previously occupied by the selected cell. This is exemplified in FIGS. 23 and 24. However, if the content of the other cell were one of the non-selected cells, it would still be spinning which is exemplified by FIGS. 25 and 26. Thus, the content of the non-selected cells does not need to be fixed during the movement of the selected cells from one cell on the display to another cell on the display. It is also possible for one or more of the selected cells to remain in the same cell before, during, or after a secondary game as long as the number of the selected cells remains constant throughout that round of secondary games.

Columns may be displayed on the display. Columns are higher than they are wide. As an illustrative example, if five columns are on the display and the secondary game is triggered, then the controller might select two columns, for example columns 2 and 5, before the secondary game starts; then, for example, selected columns may be chosen as columns 1 and 2; the number of selected columns stayed constant at two columns but the selected columns chosen were 1 and 2 in contrast to the start of the secondary game play where they were columns 2 and 5; notice also that in this example, column 2 remained selected although it need not have been so selected, as long as the number of selected columns remained unaltered during the secondary game play. On another round of a primary and secondary game, the number of selected columns may be more or less than 2 as determined at the time the next round is played.

The movement of the cells during the cell-selecting stage or prior to or during a secondary game, can take place in a variety of fashions. For example, the selected cells may be shuffled with the non-selected cells on the display where the placement of the selected cells and the non-selected cells is randomly placed in the available cells of the display. It may also be that the selected cells move in some particular manner from one cell to another on the display. For example, the selected cells may move from the left to the right at a speed that is useful for the gaming machine operator or the player. It may also be that the selected cells move in a diagonal manner through the available cells on the display. It may further be that the selected cells appear in a cell along the left edge of the available cells when the selected cell has moved to the right when it is at the right edge of the available cells as is commonly used in visual displays. It may also be that the selected cells when they reach a cell on the edge of the available cells and try to move further in the same direction that they are made to bounce back off of the edge and move toward the interior of the available cells. The selected cells could move in a vertical, horizontal or diagonal pattern according to a person's or people's preference. These are but a few means of moving the selected cells across the display. Other ways may be possible which are known in the art of moving images on displays. Column movements are similarly possible especially for lateral movement.

The cells which are selected, even if temporarily during the cell-selecting stage before being fixedly selected for that round of secondary game play, will have some indication that they are selected. The cells which are selected may, for example, have a border as an indicator. It may also be that the brightness of the selected cells is either increased or decreased by a specified amount. For example, the brightness of the selected cells may be increased by 50% over that of the non-selected cells. Furthermore, the color of the selected cells may be changed from that of the non-selected cells. For example, if the symbols are generally black and white with shades of gray, it may be that the symbol in selected cells are shown with blue and white with shades of blue. It may further be that the color tone of the selected cells is different than the non-selected cells. For example, the non-selected cells may have symbols with a variety of colors but the images in selected cells be made to have a sepia appearance. The shape of the cells may also be changed from the non-selected cells. For example, the selected cells may be made to be spherical and the non-selected cells to be made square. These are but a few of the many possibilities for indicating which cells are selected in the presence of non-selected cells. Column indications may be similarly indicated.

The gaming machine is configured to play both primary games and secondary games. Primary games may also be called feature games. Some event of the primary game triggers the game to permit a secondary game. The event may be the appearance of a symbol on the display. The event may be a specified pattern of symbols on the display. The event may be a sequence of symbols which corresponds to pay lines which may be present on the display. Regardless of the event, that specified event is a trigger for the gaming machine to permit a secondary game to be played for that primary game. The primary game may be, for examples, a slot game, a real game or a card game shown on the display. When the gaming machine has completed the primary game, it may then enter the secondary game. Prior to allowing the gaming machine to execute the secondary game, the gaming machine enters a cell-selecting or a column-selecting stage depending on whether the gaming machine is configured as a series of cells or a series of columns. The cell-selecting stage is when the gaming machine chooses which cells are selected; the column-selecting stage is when the gaming machine chooses which columns are selected. Once the number of cells to be selected is selected, the gaming machine may enter the secondary game. The secondary game is then played on the gaming machine. The selected cells will be apparent on the display during the secondary game play. These selected cells and the manner in which they are specified may have an impact on the appearance of the game, the payout of the game, the probability of winning the game, and the entertainment value of the game among other qualities. The secondary game may be a reference to one game as the secondary game or more than one game as the secondary game which are referred to as more than one free spin game. The secondary game is a reference for a group of games played as secondary games initiated after a trigger of a primary game played on the gaming machine. Every game that is designated as a secondary game played on the gaming machine constitutes the secondary game as long as the secondary game is associated with a play of the primary game which triggered the secondary game. Thus, once a secondary game has started, it may also be referred to as a round of secondary games, a round of free spin games, or free spin games for examples.

The symbols that are shown on the display are chosen from a wide variety of symbols that have been made available on the gaming machine. These available symbols make up a set which is a plurality of symbols. These symbols are of a variety of types and may in part be listed as letters, numbers, images, sketches, diagrams of objects and the like. Included in these lists would be wild symbols. Wild symbols can be any symbol chosen by the gaming machine operator or manufacturer that may be deemed suitable for potential players or operators. Wild symbols can indicate a variety of other symbols which enhance the chances of a win or winning sequence of symbols on the display. There may be more than one type of wild symbol. For example, one wild symbol might be a diamond symbol and another wild symbol might be the word WILD. The impact upon the game of the different wild symbols may or may not be the same between each other. For example, one wild symbol might represent any number while another wild symbol might represent any available symbol. Symbols may be of one or more dice in association with gaming facilities of chance or may be images or sketches of people or animals. At least one symbol might contain nothing or be otherwise blank. Of course, these symbols indicated are but a few of many that could be chosen.

A variety of symbols or the same or similar symbols can be displayed in the symbols. These symbols can be lined up in the same column such as a vertical alignment of the symbols in a slot machine or in different cells where the cells are aligned in a useful pattern such as a vertical column of three cells or in a horizontal row of four cells. The number of symbols shown vertically and horizontally need not be the same. For example, symbols each in their own cell can be shown with three in a column with four columns adjacent to each other to give a three by four grid of cells or symbols or both.

The symbols between the selected cells and the non-selected cells or between the selected columns and the non-selected columns may be distinguished for examples by: a) setting the color of the symbols of the selected cells or columns to be distinct from the symbols of the non-selected cells or columns, b) by setting the brightness of the symbols of the selected cell or column to be distinct from the symbols of the non-selected cells or columns, or c) by setting the shape of the symbols of the selected cells or columns to be distinct from the non-selected cells columns. Additionally, all of the means of distinguishing selected cells from non-selected cells applies to selected columns in contrast to non-selected columns; the means of distinguishing columns can likewise refer to the means for distinguishes selected cells from non-selected cells. These represent but a few possibilities for distinguishing symbols in selected cells or selected columns or distinguishing selected cells or selected columns themselves from non-selected cells or non-selected columns.

One of the functions of the non-selected cells is that during the secondary game they are allowed to spin or change where the contents of a selected cell (even if it is moved to another available cell) may be held constant. Any distinction in behavior between selected and non-selected cells for the game play in the secondary game constitutes a predetermined function. Another example, selected cells may be made to be all wild symbols and remain wild symbols throughout the secondary game. It is not required that the selected cells contain the same content between free spin games in the same round of the secondary game say in each of three free spin games in a secondary game. For example, the symbols may all be of a wild type in the first free spin game and may change to another symbol in a subsequent free spin game of the same round of the secondary game as long as the number of selected cells is unaltered.

The final result of the selected cells and the non-selected cells then indicate a final result for the game play. For example, the cells may align to indicate a feature of the pay lines or it may indicate a winning sequence such as a royal flush which might not be specifically shown on the pay lines.

As mentioned above, although the present invention has been concretely described, the present invention is not limited to the above embodiments and various changes and modifications may be made without departing from the scope of the invention. For example, the game pertaining to the present invention is capable of being executed even when either a stepper reel or a video reel (or virtual reel) is used. When executing the game pertaining to the present invention using the stepper reel, the display in the gaming machine may be dual structured. That is, for example, while installing a stepper reel in the gaming machine, a transparent type display can be installed on the surface side. In this way, it is possible to make the symbols on the stepper reel selectively visible to the player by adjusting the transparent type display to a transparent or non-transparent state. It is also possible to display symbols or other visual indications on the transparent type display so as to superimpose or modify the symbols on the stepper reel. For example, a transparent type liquid crystal display, a transparent type organic EL display, etc. can be used as the transparent type display.

What is claimed is:

1. A gaming machine which includes a primary game and a secondary game, where the secondary game is initiated by an event of the primary game, said gaming machine comprising:

a display, which shows a plurality of cells, wherein each cell of the plurality of cells contains a symbol from a plurality of symbols, and wherein the plurality of cells is composed of non-selected cells and at least one selected cell, the at least one selected cell having a quantity, wherein said quantity remains constant until the second game ends;

a controller, which chooses the at least one selected cell in a cell-selecting stage between the primary game and the secondary game wherein the at least one selected cell is distinctly indicated from the non-selected cells on the display and wherein the controller chooses the function of the at least one selected cell in the secondary game.

2. A gaming machine according to claim 1, wherein at least one symbol of the plurality of symbols is a composition of at least two other symbols in the plurality of symbols.

3. A gaming machine according to claim 1, wherein the at least one selected cell changes position on the display during the secondary game.

4. A gaming machine according to claim 1, wherein the symbol in each of the at least one selected cell is different in shape than symbols in the non-selected cells.

5. A gaming machine according to claim 1, wherein the at least one selected cell is different in color than the non-selected cells.

6. The gaming machine according to claim 1, wherein the quantity of the at least one selected cell is greater than one.

7. The gaming machine according to claim 1, wherein each of the at least one selected cell shows a wild symbol.

8. The gaming machine according to claim 1, wherein the primary game is a slot game using reel strips wherein each strip defines a sequence of symbols.

9. A gaming machine comprising:

a display, which shows a plurality of reels in a plurality of cells, wherein each reel specifies a sequence of symbols where each symbol is selected from a plurality of symbols;

wherein each cell contains a result symbol from one reel of the plurality of reels, wherein the plurality of cells is composed of non-selected cells and at least one selected cell in a first group and at least one selected cell in a second group;

a controller, (a) which executes a secondary game whereby each reel is spun from an initial position to the result symbol, and (b) which chooses the at least one selected cell in a first group having a first quantity of selected cells, and (c) which chooses the at least one selected cell in a second group having a second quantity of selected cells, and (d) which chooses each selected cell in the first group and each selected cell in the second group in a cell-selecting stage before the secondary game is executed, wherein the at least one selected cell in the first group is distinctly indicated from the at least one selected cell in the second group which is distinctly indicated from the non-selected cells on the display, and (e) which chooses the function of the at least one selected cell in the first group and the at least one selected cell in the second group in the secondary game, and (f) which determines an outcome of the secondary game, wherein the first quantity and the second quantity remain constant until the secondary game ends.

10. A gaming machine according to claim 9, wherein each selected cell in the first group changes position on the display during the secondary game.

11. A gaming machine according to claim 9, wherein a symbol indicating the at least one selected cell in the first group and a symbol indicating the at least one selected cell in the second group remains unchanged for more than one reel spin in the secondary game.

12. A gaming machine according to claim 9 further comprising:

a first symbol on each of the at least one selected cell in the first group;

a second symbol on each of the at least one selected cell in the second group;

wherein the second symbol in different than the first symbol.

13. A gaming machine according to claim 9, wherein the at least one selected cell in the second group changes position on the display during the secondary game.

14. A gaming machine according to claim 9, wherein at least one symbol of the plurality of symbols is a composition of at least two other symbols in the plurality of symbols.

15. The gaming machine according to claim 9, wherein the first quantity is greater than one.

16. The gaming machine according to claim 9, wherein the second quantity is greater than one.

17. The gaming machine according to claim 9, wherein each selected cell in the first group and each selected cell in the second group shows a wild symbol.

18. A gaming machine which includes a primary game and a secondary game, where the secondary game is initiated by an event of the primary game, said gaming machine comprising:

a display, which shows a plurality of columns, wherein each column contains a plurality of cells, wherein each cell contains a symbol from a plurality of symbols, and wherein the plurality of columns is composed of non-selected columns and at least one selected column, the at least one selected column have a quantity of selected columns, wherein said quantity is constant until the secondary game ends; and a controller, which chooses the at least one selected column in a column-selecting stage between the primary game and the secondary game wherein the at least one selected column is distinctly indicated from the non-selected columns on the display and wherein the controller chooses the function of the at least one selected column in the secondary game.

19. A gaming machine according to claim 18, wherein the at least one selected column changes position on the display during the secondary game.

20. A gaming machine according to claim 18, wherein the primary game is a slot game conducted using reels.

* * * * *